US007757324B2

(12) United States Patent
Leidig et al.

(10) Patent No.: US 7,757,324 B2
(45) Date of Patent: Jul. 20, 2010

(54) AUTOMATIC WASHING MACHINE WITH WASH ACTION TUB RAMPS AND CYCLES; SPIN DRAIN FLOW CHANNELS AND RESERVOIR

(75) Inventors: Steven Leidig, Webster City, IA (US); Ellingson David Irwin, Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 537 days.

(21) Appl. No.: 11/610,380

(22) Filed: Dec. 13, 2006

(65) Prior Publication Data

US 2008/0141732 A1 Jun. 19, 2008

(51) Int. Cl.
*D06F 33/02* (2006.01)
*D06F 23/04* (2006.01)
*D06F 37/14* (2006.01)

(52) U.S. Cl. ..... 8/159; 68/12.12; 68/12.23; 68/58; 68/133; 68/142

(58) Field of Classification Search ..... 68/12.12, 68/12.23, 58, 133, 142, 147
See application file for complete search history.

(56) References Cited

U.S. PATENT DOCUMENTS 1,701,187 A * 2/1929 Maus ..... 68/174
2,224,241 A 12/1940 Lafayette et al.
2,302,012 A * 11/1942 Dyer ..... 68/23.3
2,369,905 A 2/1945 Page
2,575,691 A 11/1951 Smith
2,603,982 A 7/1952 Davis et al.
2,648,964 A 8/1953 Graham (Continued)

FOREIGN PATENT DOCUMENTS

GB 745133 2/1956

(Continued)

OTHER PUBLICATIONS

Original claim set from copending U.S. Appl. No. 11/610,336.

(Continued)

*Primary Examiner*—Joseph L Perrin
(74) *Attorney, Agent, or Firm*—Banner & Witcoff, Ltd

(57) ABSTRACT

An automatic washing machine includes a wash basin having a plurality of apertures and an annular liquid reservoir formed at an upper portion of the basin. A plurality of flow channels are arranged around the exterior surface of the wash basin. The plurality of flow channels includes upward flow channels, configured for directing wash liquid extracted from the wash basin into the reservoir under centrifugal force generated in a spin cycle. The plurality of flow channels also includes downward flow channels configured for directing wash liquid from the reservoir to a central drain following the spin cycle. The arrangement avoids the need for an outer wash tub, and at the same time provides stabilization to the wash basin during high speed spins. In another aspect, the wash basin may include wash action ramps provided on a bottom surface of the wash basin and at an upper sidewall of the wash basin. The wash action ramps, in conjunction with a sequence of wash basin acceleration and deceleration cycles, induce an effective wash action, and circulation of the wash load, in lieu of a conventional central agitator.

20 Claims, 25 Drawing Sheets

U.S. PATENT DOCUMENTS

| | | | | | |
|---|---|---|---|---|---|
| 2,718,772 | A | | 9/1955 | Sharp et al. | |
| 2,742,772 | A | * | 4/1956 | Romine | 68/23.4 |
| 2,854,144 | A | | 9/1958 | Smith | |
| 3,216,224 | A | | 11/1965 | Poole | |
| 3,216,226 | A | * | 11/1965 | Alger et al. | 68/23 R |
| 3,738,130 | A | | 6/1973 | Smith | |
| 3,740,975 | A | * | 6/1973 | Cornelius | 68/18 F |
| 4,202,187 | A | | 5/1980 | Hukuzawa et al. | |
| 4,468,938 | A | | 9/1984 | McMillan | |
| 4,888,965 | A | | 12/1989 | Fanson et al. | |
| 5,191,667 | A | * | 3/1993 | Roy et al. | 8/158 |
| 5,199,127 | A | * | 4/1993 | Van Newenhizen et al. | 8/158 |
| 5,271,251 | A | | 12/1993 | Kovich et al. | |
| 5,548,979 | A | | 8/1996 | Ryan et al. | |
| 5,878,602 | A | | 3/1999 | Kovich et al. | |
| 6,247,339 | B1 | | 6/2001 | Kenjo et al. | |
| 6,871,370 | B2 | * | 3/2005 | Choi et al. | 8/159 |
| 7,269,870 | B2 | * | 9/2007 | Kim | 8/158 |

FOREIGN PATENT DOCUMENTS

| | | |
|---|---|---|
| JP | 55024016 | 2/1980 |

OTHER PUBLICATIONS

Office Action mailed Oct. 28, 2009 in related (concurrently filed) U.S. Appl. No. 11/610,336.

* cited by examiner

AUTOMATIC WASHING MACHINE WITH WASH ACTION TUB RAMPS AND CYCLES; SPIN DRAIN FLOW CHANNELS AND RESERVOIR

BACKGROUND

Automatic washing machines have existed for many years. Conventional automatic washing machines generally include an external cabinet containing a dual tub arrangement in which an inner perforated tub (wash basket) rotates within an outer tub that remains generally stationary. In addition, conventional washing machines include a central column that can rotate independently and act as an agitator.

In a typical wash cycle, clothing is loaded into the wash basket. The outer tub and nested wash basket are filled with wash liquid to a predetermined level and the central column agitates the wash load within the liquid to cleanse the clothing. Once the wash cycle is complete, wash liquid is drained from the outer tub via a drain outlet provided therein. The wash basket then rotates (spins) at a high rate of speed to force wash liquid absorbed by the wash load out of the load, through the wash basket apertures and into the outer tub, from which it is drained via the drain outlet.

The conventional arrangement of a pair of nested wash tubs, and a central agitator rotatable independently of the wash basket, has been a main stay of the industry for decades, serving relatively well in terms of its washing effectiveness and its reliability. This conventional arrangement is not without its shortcomings, however. For example, the requirement of an inner as well as an outer tub increases materials, manufacturing and assembly costs as compared to the case if only a single tub were required. Additionally, the nesting of one tub within another takes up space within the washer cabinet that could otherwise be used to increase load capacity. Likewise, the requirement for two independently rotatable elements, a central agitator and an inner rotatable tub, increases cost and mechanical complexity as compared to the case if both wash agitation and spin action could be accomplished with just a rotatable tub. Finally, the dual tub arrangement requires additional water usage for a given load size, since the space between the outer stationary tub and the inner wash basket must be filled to the desired water level, yet this volume of water does not substantially contact the wash load or aid in the wash action.

Washing machines have been proposed that employ tub rotation as a means for agitating the wash load during the wash cycle. For instance, U.S. Pat. No. 5,271,251 to Kovich et al. discloses a tub with at least one ramp on the floor of an inner wash basket (nested within a stationary outer basket). The ramp is configured to be used in conjunction with a baffle mounted to a sidewall of the wash basket. It is apparent that the baffles are located at least partially below the standing water line on the inner surface of the tub. The bottom ramps are positioned to guide the wash load upward and outward, toward the sidewall of the tub, into engagement with the baffle surfaces that then cause the load to tumble around the baffle.

U.S. Pat. No. 5,878,602 to Kovich et al. discloses baffles spaced about a cylindrical wall portion. No bottom ramps are used in the '602 patent. Rather, a rotatable wash plate is nested in the tub bottom and includes a pair of diametrically opposed ripples or ridges. The wash plate imparts a vertical motion to the load as the wash plate is oscillated.

BRIEF SUMMARY OF SELECTED INVENTIVE ASPECTS

In accordance with an aspect of the invention, a washing machine includes a frame and a wash basin assembly rotatably mounted within the frame. The wash basin assembly includes a wash basin container having a bottom and sidewalls extending up from the bottom. A reservoir is arranged at least partially about the sidewalls of the wash basin container. A first plurality of flow channels extends along the sidewalls and is provided in fluid communication with an interior of the wash basin container so as to receive a flow of wash liquid expelled therefrom. The flow channels are configured to expel the wash liquid along the sidewalls and into the reservoir. A reservoir drain is provided for draining wash liquid from the reservoir. The reservoir drain may take the form of a second plurality of flow channels provided to direct the wash liquid from the stabilizing reservoir to a central drain once the wash basin rotation slows and/or stops.

Such an arrangement can advantageously be used to avoid the need for a separate outer splash tub, thus presenting an opportunity to save on washer weight and costs associated with the assembly/manufacturing of the washer. In addition, elimination of an outer tub can make additional space available within the washer housing for increasing the load capacity of the washer without increasing the washer footprint. Further, elimination of an outer tub may reduce the amount of water needed for a given wash load. Additionally, such a single tub arrangement may eliminate the need for a clutch and gearbox which may add mechanical complexity to the washing machine.

In another aspect, an automatic washing machine includes a frame and a wash basin assembly rotatably mounted within the frame. The wash basin assembly includes a wash basin container having a bottom and sidewalls extending up from the bottom. At least one bottom ramp is affixed to and extends upwardly from the wash basin container bottom and presents an upwardly inclined ramp surface. A drive system is provided for selectively rotatably driving the wash basin container, and a controller is provided for controlling the drive system to repeatedly intermittently rotatably drive and brake the wash basin container during a wash cycle of the washer, to thereby cause the wash basin container to alternatively accelerate and decelerate.

At least one sidewall ramp may be affixed to the wash basin container sidewall and present an inwardly inclined ramp surface. The at least one sidewall ramp may be spaced above the top of the at least one bottom ramp.

The acceleration and deceleration causes the at least one bottom ramp to induce a wave wash action on wash liquid within a lower portion of the wash basin container, by liquid flowing over the at least one ramp as the liquid continues to rotate within the wash basin container following an acceleration/deceleration cycle of said wash basin container. The acceleration/deceleration cycle further induces in the wash liquid parabolic water profile formation and collapse actions serving, in conjunction with the at least one sidewall ramp (if provided), to circulate the load so that a portion of the wash load in an upper portion of the wash basin container is circulated to a lower portion of the wash basin container where it can be subjected to the wave wash action induced by the at least one bottom ramp.

Such an arrangement can provide a highly effective and efficient wash action while advantageously eliminating the need for a central agitator and a complex transmission for independently oscillating the central column to agitate the load. An arrangement as described is also well suited to application in a single tub automatic washer configured in accordance with the above-described first aspect of the invention.

In still another aspect, a method of washing a load of laundry using an automatic washing machine includes placing a load of laundry within the wash basin container. The wash basin container is rotatably mounted within a frame. The wash basin container includes a bottom and sidewalls extending up from the bottom. The wash basin container further includes a reservoir arranged at least partially about the sidewalls of the wash basin container to rotate therewith. The method further includes expelling wash liquid to flow from the wash basin upward to the reservoir while the wash basin is being rotated. The method also includes flowing the wash liquid from the reservoir downward to a drain.

Such a method may provide a highly effective and efficient method for washing a load of laundry. The method described minimizes the amount of water necessary to wash the load and also eliminates the need for an outer tub which increases the cost and weight of the washing machine.

This summary is provided to introduce a selection of concepts of the inventive subject matter that are further described below in the detailed description. This summary is not intended to identify essential features or advantages of the claimed subject matter, nor is it intended to be used to limit the scope of the claimed subject matter. Additional features and advantages of various embodiments are further described below.

BRIEF DESCRIPTION OF THE DRAWINGS

Aspects of the invention are illustrated by way of example and not by limitation in the accompanying figures in which like reference numerals indicate similar elements and in which.

DETAILED DESCRIPTION OF EXEMPLARY EMBODIMENTS

Figure 1:
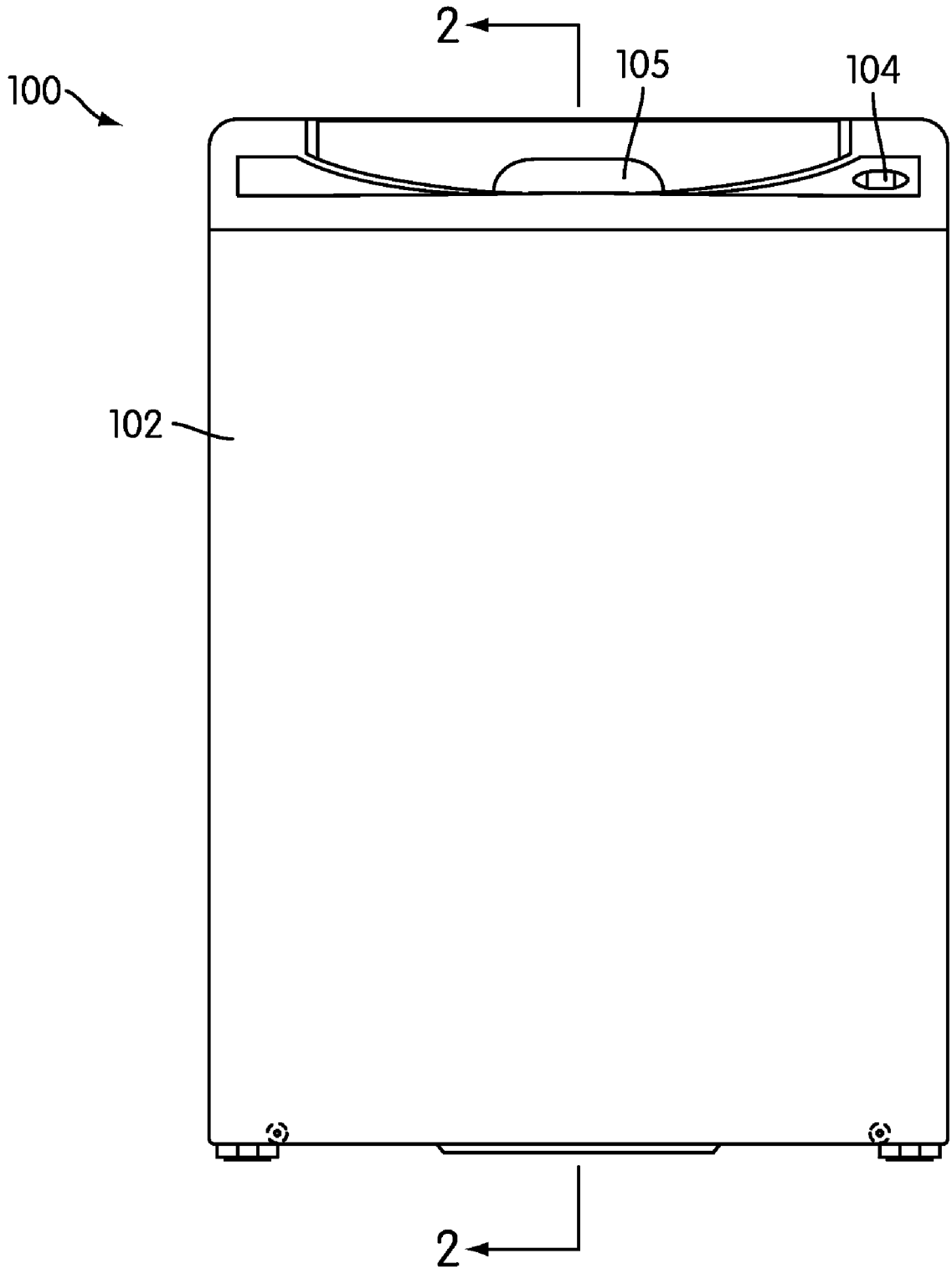
FIG. 1 is a front elevational view of an exemplary automatic washing machine embodying inventive aspects described herein.
Figure 2:
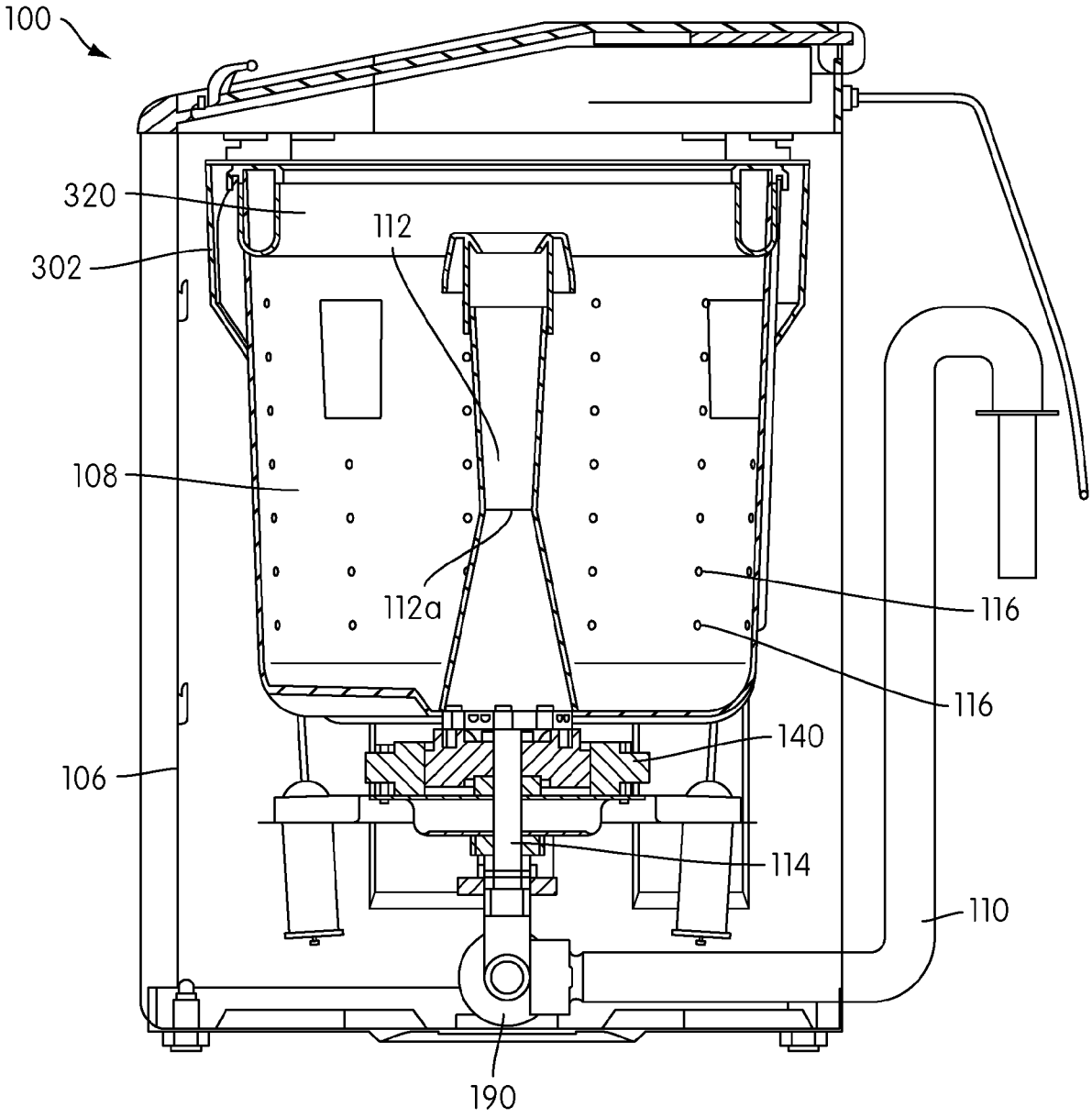
FIG. 2 is a cross-sectional view of the automatic washing machine of FIG. 1 taken along line 2-2 shown in FIG. 1.

With reference to FIGS. 1-2, there is shown one example of an automatic washing machine 100 embodying various aspects of the invention. Washing machine 100 includes an external generally rectangular cabinet 102, a control panel 104 for controlling the washer operation, and a hinged lid 105 that may be swung open to provide top-load access to a cylindrical wash basin 108 (FIG. 2). As shown in FIG. 2, cabinet 102 is provided as part of a framework 106 that contains a suspended wash group. The wash group includes cylindrical wash basin 108, which is rotatably mounted and configured for containing a wash load and wash liquid.

Automatic washing machine 100 also includes a central upstanding column 112 centrally mounted to the bottom of wash basin 108. In contrast to the conventional arrangement, central column 112 is preferably fixedly mounted to the wash basin, rather than being made independently rotatable.

Prior to discussing the structure of automatic washing machine 100 in detail, the basic stages of operation are briefly outlined.

In use, after placing a load of laundry in wash basin 108, along with a suitable type and quantity of laundry detergent, a wash process is initiated by an operator through interaction with control panel 104. The process typically begins with a tub fill cycle, wherein water enters the wash basin 108 via an inlet hose, valve and nozzle (not shown). Water fills the wash basin 108 to a predetermined level, which may be varied, e.g., as a user setting and/or depending upon the size of the wash load. Once the appropriate/set level is reached, the water supply valve is closed and the washer enters a wash cycle comprising a number of sequential stages. In accordance with an aspect of the invention, these stages may take the place of the conventional agitation cycle of a conventional washer having a central independently rotatable agitator column. As will be described in further detail, this wash cycle may include intermittent rotation of the wash basin 108 in one or two directions, i.e., starting and stopping of the rotation of the wash basin 108, to impart, in conjunction with specially configured and placed wash basin-mounted ramps, a highly effective wash action and circulation of the wash load.

Upon completion of the wash cycle, a static drain of the wash liquid from the wash basin 108 is carried out via a central drain pipe 114. Once the free wash liquid (liquid not absorbed into the wash load) pooled within the wash basin 108 is drained, a spin cycle is initiated wherein the wash basin is rotated at a high rate of speed. This rotation of the wash basin 108 forces wash liquid absorbed into the wash load out of the load, and out of the wash basin through the apertures 116 formed in the side of the wash basin 108. This sets the spin drained water on a unique and advantageous drainage path to be described in detail. The wash load may then be subjected to another rinse cycle, in which the water supply valve is again opened to allow fresh water to enter the wash basin 108. The wash basin is again rotated to generate a vigorous rinse action and the static and spin drain cycles outlined above are repeated.

In conventional washing machines, a central auger-like column rotates independent of the wash basin and acts as an agitator to impart a mechanical wash action on the clothes during the wash cycle. In the arrangement shown in FIG. 2, the mechanical wash action may be accomplished by alternative methods, to be discussed below in detail. In this case, central column 112 may be affixed to the wash basin and used as a device for dispensing rinse agent (i.e., fabric softener). The central column 112 may also act as a cover for a central drain unit, lint trap, etc., and to provide a more aesthetically pleasing and familiar appearance to the interior of wash basin 108. Since column 112 is not required or used for imparting agitation to the wash load, it may be omitted entirely, in which case a simple cover could be provided over the rotation axis. Passages could then be provided in the cover to allow for selective drainage of wash liquid though central drain 114.

In arrangements of the invention where a central column is present, the shape of the central column 112 may also aid in ensuring a freely moving wash load. For instance, the tapered, generally hourglass shape of the central column 112 can aid in preventing tangling of larger wash load items around the column 112. Large items, such as a bed sheet, may have a tendency to wrap around the column 112 during a wash cycle involving rotation of wash basin 108. The narrow portion 112*a* of the hourglass shape allows the larger items to wrap around the column 112 and slide toward this narrow portion 112*a* where it can more easily free itself from the column 112. In addition, positioning the narrow portion 112*a* of the column 112 beneath the standing water line also aides in preventing and removing tangled wash load items as the wash load is likely to move more freely when submerged in water.

Figure 3:
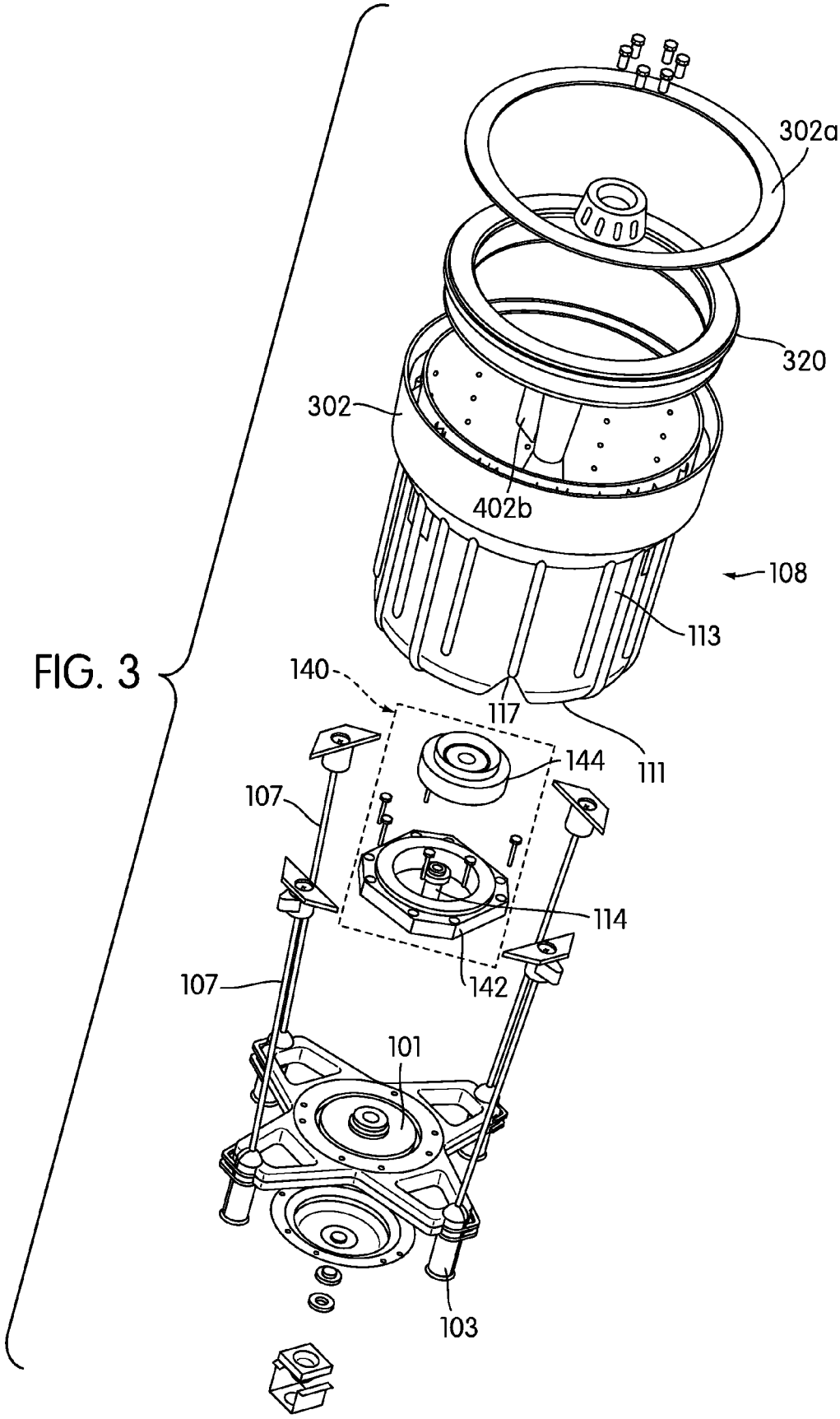
FIG. 3 is an exploded view of the automatic washing machine of FIG. 1.

Additional details of washing machine 100 are now described with further reference to the exploded view of FIG. 3. Wash basin 108 includes a circular bottom 111 and, preferably, integrally formed cylindrical walls 113 forming the container or basin which holds the wash load and wash liquid. An annular liquid reservoir 302 and a stabilizing fluid-filled sealed ring 320 are generally arranged to surround an upper portion of the cylindrical basin walls 113. An annular top portion 302*a* may be provided for covering an otherwise open top of reservoir 302.

Wash basin 108 is positioned atop a flexible suspension mount as part of the suspended wash group. As is generally known, a suspension mount of the wash group allows movement and forces generated upon rotation of a wash basin with a wash load to be isolated rather than transmitted to the frame and housing of the washer. In the illustrated embodiment, the suspension mount includes a four pronged suspension base plate 101 to which a drive motor 140 and wash basin 108 are mounted. Base plate 101 rests atop a set of four compression spring dampeners 103, one positioned at the tip of each of the prongs of plate 101. The dampeners, which are mounted at the ends of rods 107, provide a buffer serving to isolate the movement and vibration of the wash basin during spinning, and may include on the upper ends of the compression springs respective resilient foam pistons. The composite structure serves to dampen vibrations, as well as larger oscillations. In one arrangement, the foam piston comprises a relatively large cell foam disc serving as a reservoir for lubricating oil, and a smaller celled foam disc provides a low friction contact surface for sliding within a cylindrical sleeve which houses the spring/piston assembly. Rods 107 extend through the spring dampeners 103 and through the suspension base plate 101. Rods 107 extend up to and are attached at the four upper corners of the frame (106 in FIG. 2) of the washing machine 100, such that the wash basin 108 is flexibly suspended within the external cabinet 102.

In the exemplary arrangement shown in FIG. 3, drive motor 140 is centrally mounted to the suspension base plate 101 and positioned directly below the wash basin 108, concentric therewith. Drain pipe 114 advantageously doubles as a motor shaft which extends from motor 140 to the bottom of wash basin 108, to transmit a driving force for rotating wash basin 108. In one arrangement, pipe/shaft 114 may be attached at its upper end to a trunion (not shown) which is bolted to the bottom of wash basin 108, in axial alignment therewith. The trunion, which may be formed of cast corrosion resistant metal, is configured to transfer the drive forces from the motor 140 to the wash basin 108, while minimizing the stress on the construction material (e.g., molded plastic) of the wash basin 108. The trunion may be arranged within the wash basin 108 or on an exterior bottom surface of wash basin 108. In the arrangement of FIG. 3, rotor 144 doubles as a trunion that serves to transfer drive forces from the motor 140 to the wash basin 108. Additionally, drain pipe/motor drive shaft 114 passes through and is fixedly attached to rotor 144 at its center. Preferably, pipe/shaft 114 is mounted in a bearing which maintains the axial alignment of the shaft and rotor 144 within motor stator 142 during rotation.

In the illustrated arrangement, the motor is a brushless DC permanent magnet direct drive motor (BLDC). Use of a BLDC motor allows for improved speed control and braking, which is beneficial in connection with carrying out aspects of the invention. For instance, a BLDC motor may be precisely controlled in its rotational accelerations and decelerations of the wash basin, to thereby allow for better control over the wash action imparted on the wash load. Too much mechanical wash action can damage clothing and break up suspended soils causing them to re-enter the clothing. Better motor control, such as is afforded with a BLDC motor, can provide better control of the intensity of the mechanical wash action corresponding to a selected cycle setting, e.g., when adjusting for delicate loads rather than a typical "normal" wash load.

In another exemplary arrangement, the motor may be a continuous induction-type motor. This type of three-phase motor, used in conjunction with a suitable motor controller, allows the speed of the motor to be controlled, as opposed to the simple on-off control of a conventional induction motor. In addition, as an alternative to a direct drive, a belt drive arrangement may be employed to rotate the wash basin.

Exemplary wash basin 108 is shown with additional detail in FIGS. 4-7. Wash basin 108 includes a plurality of apertures 304 extending through its inner side wall. Apertures 304, which may be arranged in spaced vertical lines as shown, are configured to permit wash liquid to flow therethrough as the wash basin 108 rotates during the spin cycle. During the spin cycle, centrifugal forces cause the wash liquid to flow to and along the inner surface of the cylindrical wall 113 of wash basin 108, and into apertures 304.

Figure 4:
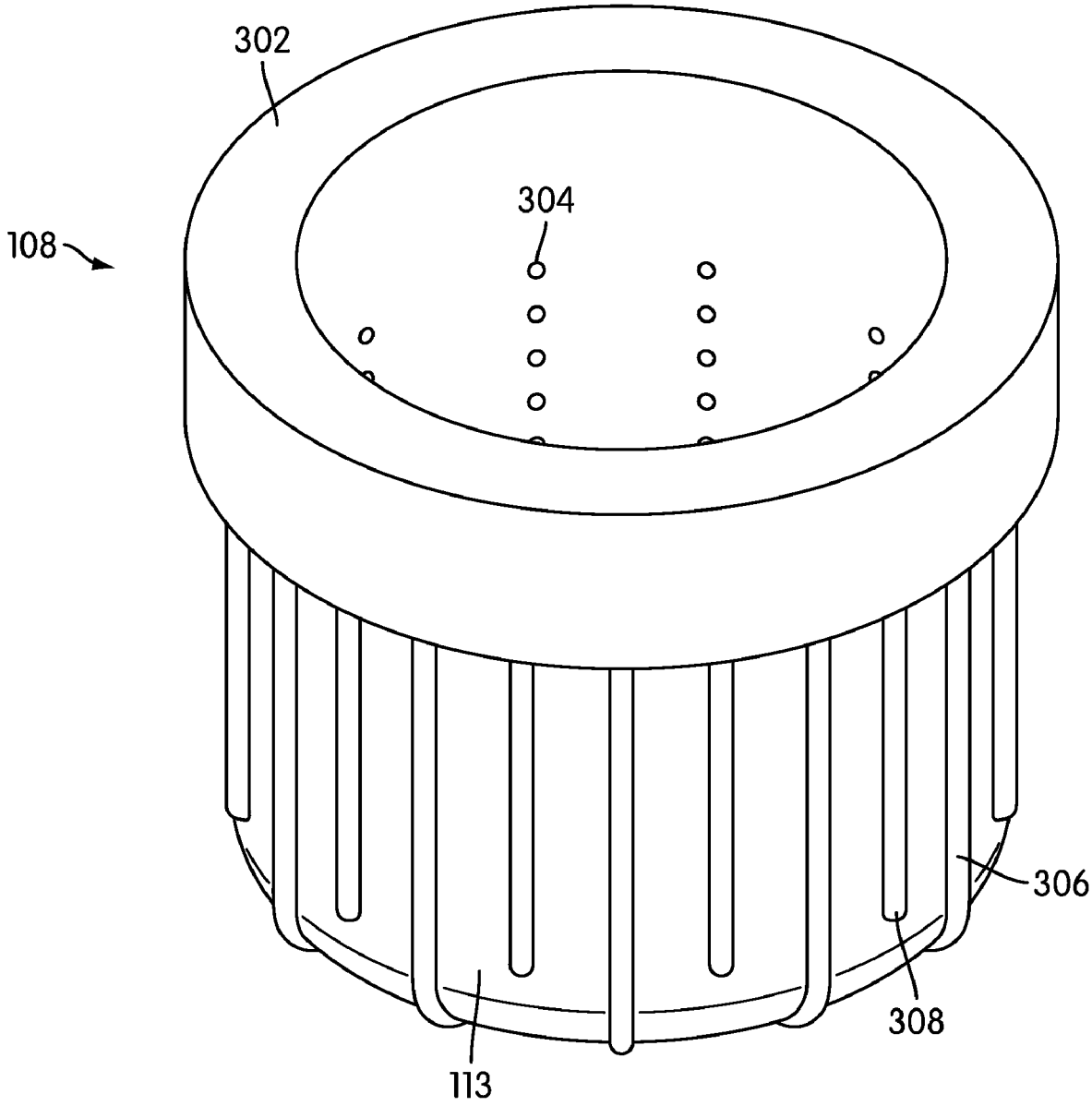
FIG. 4 is a perspective view of one arrangement of a wash basin of the automatic washing machine of FIG. 1.
Figure 5A:
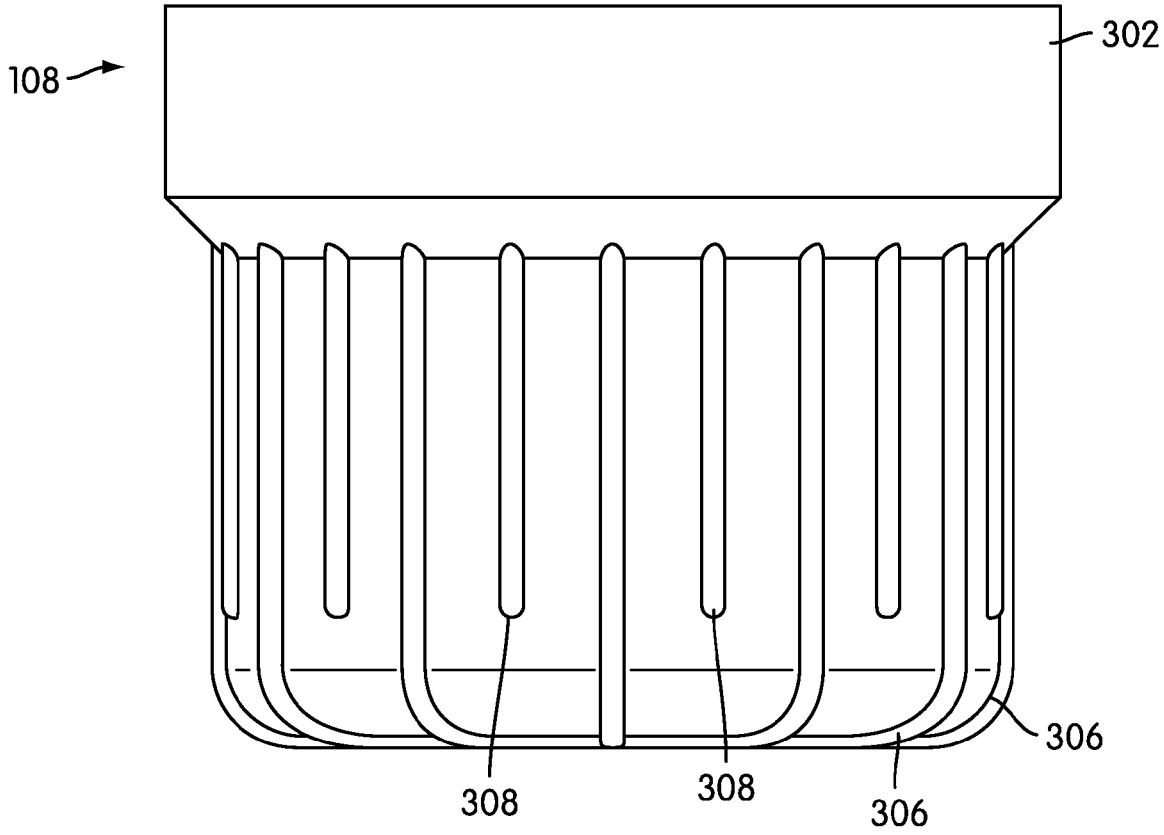
FIG. 5A is side elevational view of the wash basin of FIG. 4.

Wash basin 108 further includes a plurality of flow channels 306, 308 arranged around the outer surface of the cylindrical wall 113 of wash basin 108. As shown in FIGS. 4 and 5A, flow channels 308 extend vertically, in overlying registry with corresponding vertical arrays of apertures 304, so as to receive wash liquid flowing out of the wash basin 108 through the apertures 304 during the spin cycle. Flow channels 308 extend up and into annular reservoir 302 situated about the top of the wash basin 108. Reservoir 302 serves to receive, through flow channels 308, and to temporarily retain, wash liquid removed from the wash load during the spin cycle. In so doing, reservoir 302 transforms into a stabilizing fluid ring, which may supplement the stabilizing effect of the conventional sealed fluid ring 320 (FIG. 3), or ideally take its place completely.

More specifically, the wash liquid in reservoir 302 acts to provide a stabilizing and balancing hydrodynamic weight distribution tending to move the center of mass of wash basin 108, and the contained wash load, toward the center of rotation. In this manner, the stabilizing reservoir may act to provide a sufficient stabilizing force to eliminate the need for a separate conventional stabilizing ring. On the other hand, it may be desirable to use reservoir 302 in conjunction with a conventional stabilizing fluid ring, so as to provide a stabilizing action at the outset and end of the rotation intervals, when reservoir 302 is not filled with a stabilizing volume of the wash liquid.

Flow channels 306 are also arranged about the wash basin 108, and extend vertically downward from reservoir 302 to central drain 114 provided at the center of wash basin 108. In the illustrated exemplary arrangement, the upward and downward flow channels 308, 306 are arranged in an alternating pattern of vertical lines about the cylindrical outer surface of the wash basin 108. The inlets of the downward flow channels 306 are advantageously positioned at the lowest portion of reservoir 302 so as to permit all of the liquid within the reservoir to drain therethrough under the force of gravity, unless retained within the reservoir by counteracting centrifugal forces.

Figure 5B:
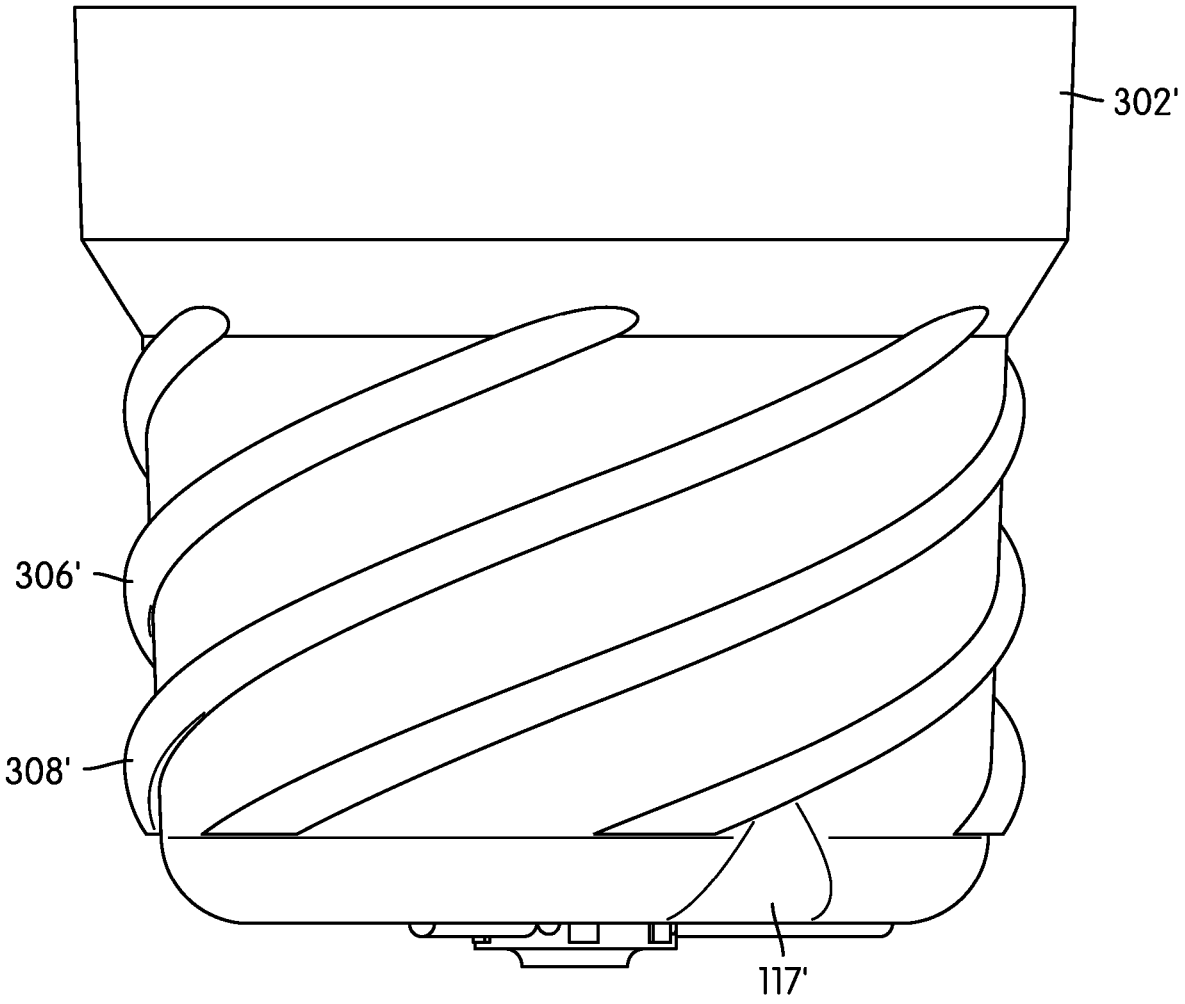
FIG. 5B is a side elevational view of an alternative configuration of a wash basin of the automatic washing machine of FIG. 1.

In another illustrative arrangement, shown in FIG. 5B, the upward and downward flow channels 306', 308' may be arranged to extend along a generally spiraling path from the stabilizing reservoir 302 down, so as to transport spin drain water 180° to a compartment of annular reservoir 302 located on a side of wash basin 108 directly opposite the point from which the water was removed from the tub. This can serve to further aid in balancing the wash load by distributing the weight of the water to a side of the stabilizing reservoir 302 opposite an unbalanced wash load portion from which water is extracted during the spin cycle. A further discussion of approaches for compartmentalizing the reservoir is provided later, with reference to FIGS. 15 and 16.

The upward and downward flow channels may be arranged about the circumference of the wash basin in various patterns. For example, there may be two or three consecutive upward flow channels 308 followed by a single downward flow channel 306, and so on. The arrangement shown in FIGS. 10 and 11 has three consecutive upward flow channels, followed by a downward flow channel, followed by a single upward flow channel, followed by a single downward flow channel. The pattern then repeats. Such patterns may be useful in order to provide spaces for accommodating other features of the wash basin, such as integrally molded wash action ramps, as will be described. The relative numbers and sizes of the upward and downward flow channels can be varied based upon competing concerns. For example, increasing the number or size of upward flow channels 308 can advantageously provide faster water extraction during the spin cycle, but increases the volume of water required to achieve a given level of water fill in the tub, given the fact that these channels will fill with water along with the wash basin. Additionally, excessively increasing the size and/or number of the flow channels may introduce manufacturing difficulties or structural issues.

Wash basin 108 and flow channels 306, 308 may be formed using various suitable methods and materials. In one embodiment, wash basin 108 and flow channels 306, 308 are integrally formed of talc filled polypropylene, by injection molding. An integral molding of the wash basin and flow channels as one piece is desirable to maintain the water tight seal of the wash basin 108 and flow channels 306, 308. Fluid-assisted molding techniques, such as water-assisted or gas-assisted injection molding, may facilitate the formation of the elongated flow channels 306 and 308.

Figure 6:
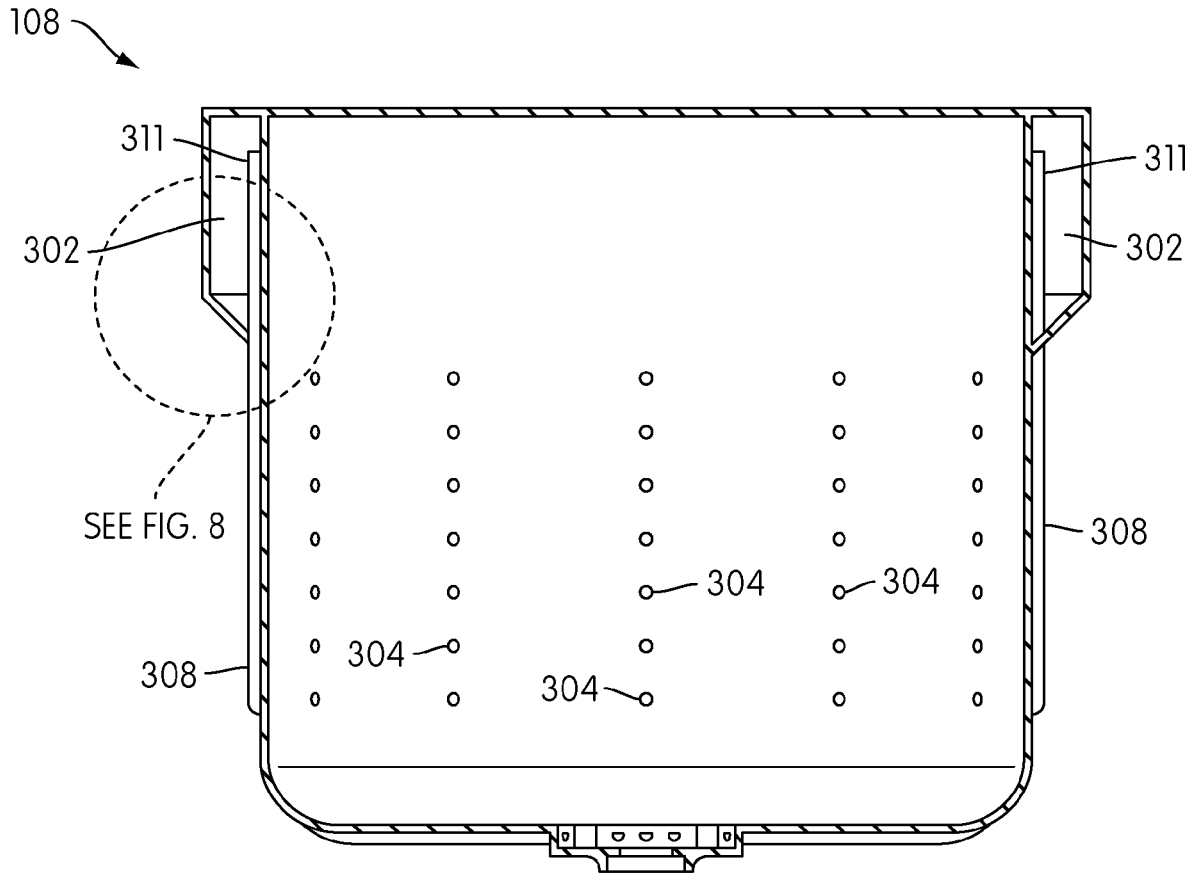
FIG. 6 is a radial cross-sectional view of the wash basin of FIG. 4, showing lines of apertures in the tub and upward flow channels in accordance with an aspect of the invention.
Figure 7:
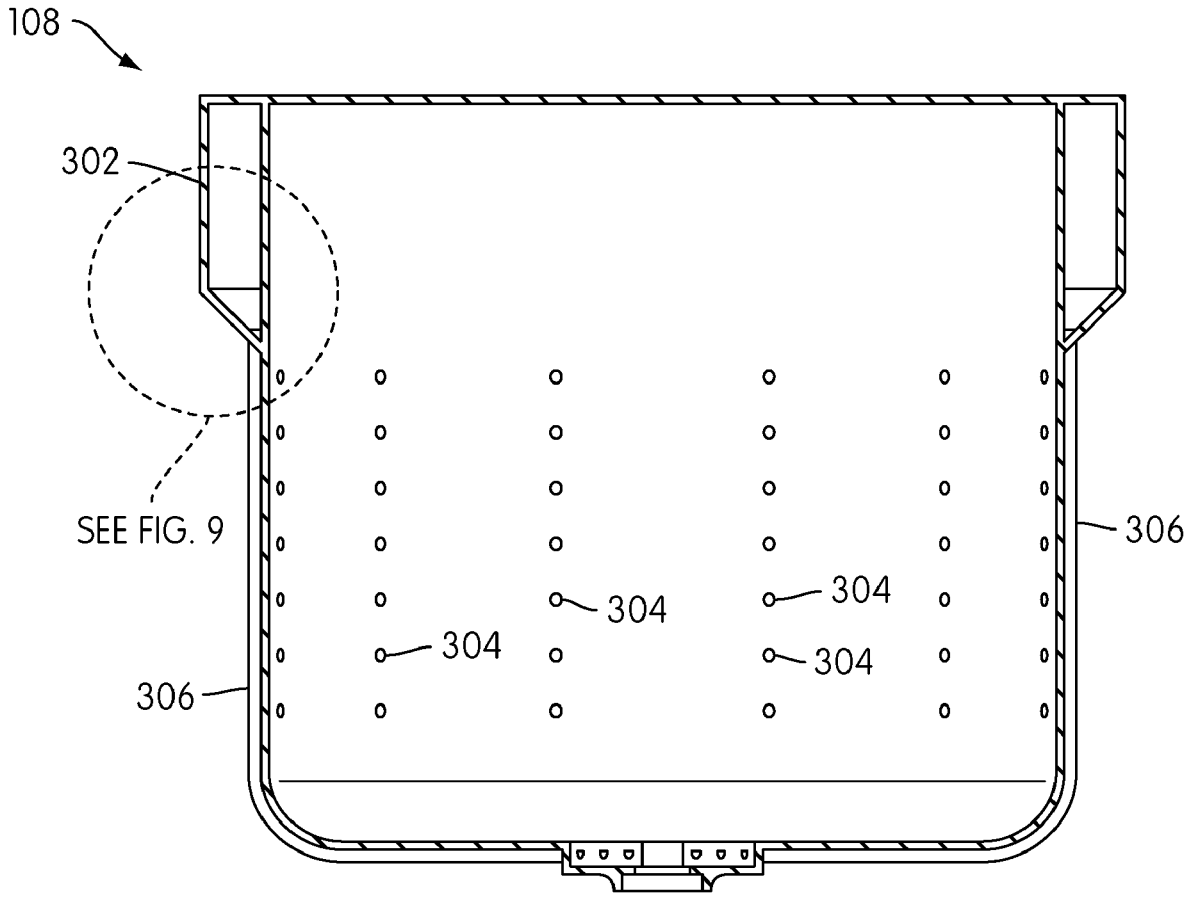
FIG. 7 is a radial cross-sectional view of the wash basin of FIG. 4, showing downward flow channels in accordance with an aspect of the invention.
Figure 8:
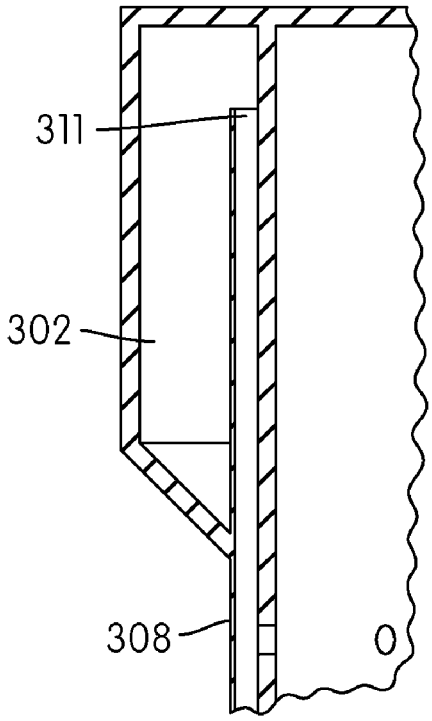
FIG. 8 is a close-up partial perspective view of the upper portion of one of the upward flow channels of the wash basin in FIG. 6, extending within a stabilizing reservoir of the wash basin according to an aspect of the invention.

FIGS. 6 and 8 show the top end 311 of upward flow channels 308 where wash liquid exits the channel 308 and is deposited in the stabilizing reservoir 302. As mentioned, upward flow channels 308 are aligned with the lines of apertures 304 in the wash basin 108, so as to receive wash liquid forced out of the wash basin 108 by centrifugal forces generated during the spin cycle. The centrifugal forces developed during the spin cycle are of such magnitude as to cause the expelled wash liquid to flow upwardly within the channels, against gravitational forces, and into reservoir 302. The sidewall of the wash basin 108 may be constructed with a slight outward inclination to aid in channeling the wash liquid upward, toward reservoir 302. The outward flare of the sidewall may, e.g., be between ½° and 5° from vertical. In addition, this angle provides a draft which aids in mold release following injection molding of wash basin 108.

During the spin cycle, wash liquid extracted from the wash load is collected in the stabilizing reservoir 302. In one arrangement, the spin cycle includes a slow initial acceleration to allow a portion of the wash liquid to enter the stabilizing reservoir 302 to aid in balancing the load prior to reaching a full-speed spin. Stabilizing reservoir 302 may include a plurality of baffles (460 in FIG. 15) that compartmentalize the stabilizing reservoir to provide a partial flow restriction. As shown, the baffles are spaced at radial intervals throughout reservoir 302 (404 in FIGS. 15 and 16). The baffles provide a partial impediment to the flow of wash liquid in the reservoir at the start of the rotational acceleration. This prevents pooling of the wash liquid in one portion of the reservoir 302, which may occur on initial acceleration. As illustrated, the baffles are preferably sized to be larger at the bottom portion than at an upper portion. This arrangement allows minimal circumferential liquid flow toward the bottom of the reservoir 302 where the liquid gravitates in slow or no spin state, and greater flow at an upper portion of the reservoir 302 where much of the liquid will be forced to reside at full spin speed. In the case that a spiral arrangement of upward flow channels 308' is utilized, as shown in FIG. 5B, it may be desirable to provide compartments which have a greater (or even complete) degree of circumferential (inter-compartmental) liquid flow restriction, in order to optimize the stabilizing effect.

Reservoir 302 is preferably sized sufficiently large to accommodate a substantial portion of the wash liquid typically remaining in the wash basin 108 and wash load after a static drain of the wash liquid (for an expected range of wash load sizes). As one example, reservoir 302 may be sized to accommodate the full amount of wash liquid typically remaining after a static drain. Alternatively, especially in the case of a very large load capacity, reservoir 302 could be sized to accommodate a selected fraction of the anticipated volume of wash liquid remaining after a static drain. In this case, multiple cycles of wash basin spinning and stopping (or slowing) may be carried out to extract and drain substantially the entire amount of extractable liquid in successive portions. For example, reservoir 302 may be sized to accommodate one half of the wash liquid expected to be remaining in a large load after a static drain. In this case, after the static drain, a two-step spin drain process may be implemented in which the wash load is rotated to expel a first portion of the wash liquid in the load and then rotation is temporarily stopped to allow this wash liquid to drain from the reservoir 302 through downward flow channels 306. The temporary pause in the spin drain cycle may be, e.g., approximately 15-30 seconds. The spin drain process is then repeated a second time to remove the remaining extractable wash liquid.

The wash liquid is drained from the reservoir 302 under the force of gravity via the downward flow channels 306 immediately following termination of the spin cycle. As shown, e.g., in FIGS. 4, 5A, 7 and 9, downward flow channels 306 are arranged to extend from the lower portion of the stabilizing reservoir 302, along the exterior wall of the wash basin 108, to the bottom of the wash basin 108. In an alternate arrangement, the downward flow channels 306 may be arranged to extend along the exterior wall of the wash basin 108 to a predetermined point and then transition to extend along the interior of the wash basin 108 to the central drain. Such an arrangement, shown in FIGS. 10A-10B, may include a tray or plate 800 that nests within the bottom of the wash basin 808. The plate 800 generally serves to provide an upper sealing surface for a segment of the downward flow channels 806 extending open-faced along the inner bottom surface of the wash basin. For instance, plate 800 may be inserted into the wash basin 808, as indicated by arrows 810, and snapped in place on top of these flow channel segments which may be molded into the bottom surface of the wash basin 808. Plate 800 seals off these flow channel segments to prevent wash liquid from re-entering the wash basin 808 from the downward flow channels 806, and also to prevent wash liquid within the wash basin 808 from entering the downward flow channels 806 and draining through the central drain.

Figure 10A:
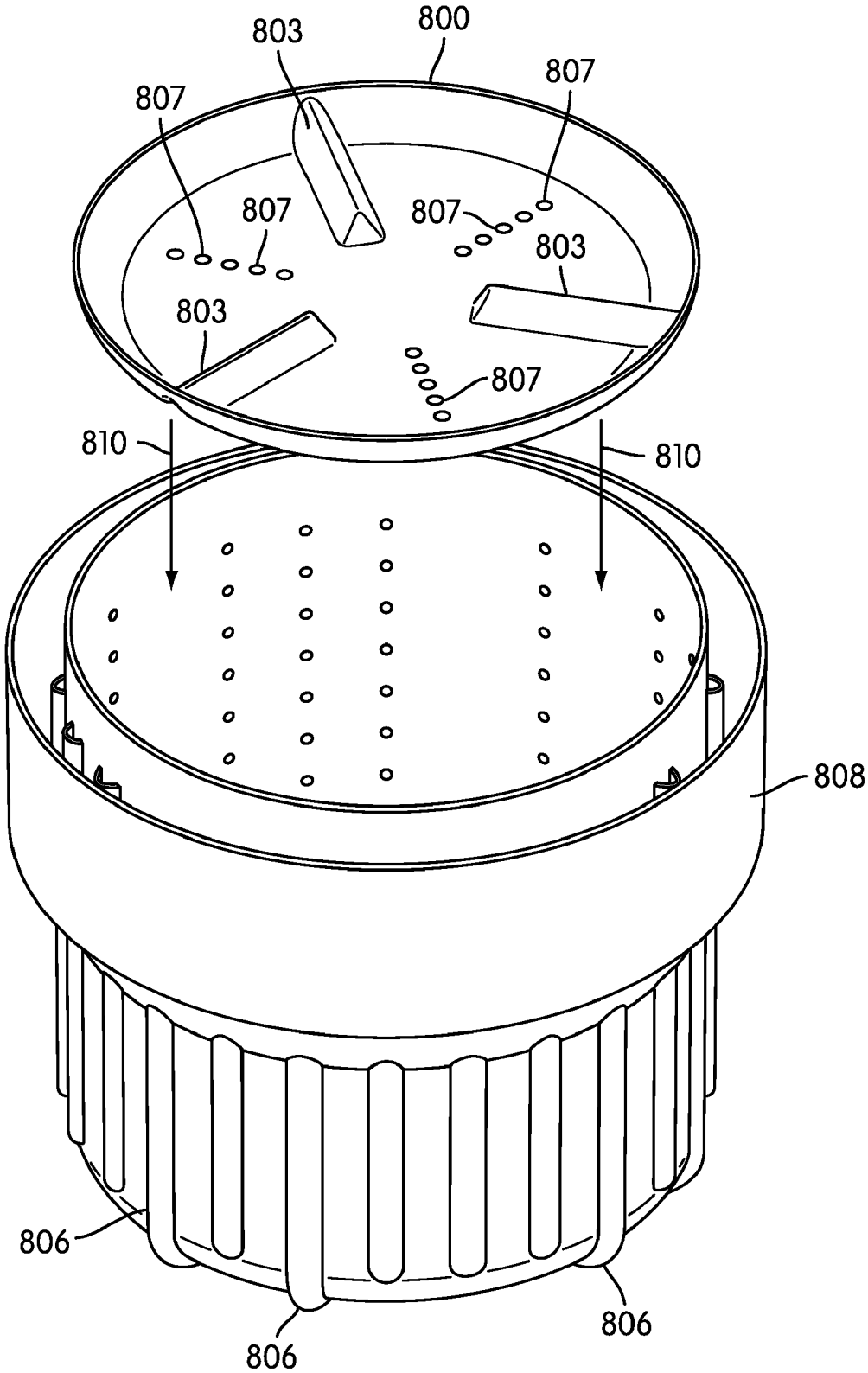
FIG. 10A is a perspective view of a further alternative configuration of a wash basin of the automatic washing machine of FIG. 1, showing an internal tray or plate that is nested in the bottom of the wash basin, used for sealing a bottom open faced segment of the downward flow channels.
Figure 10B:
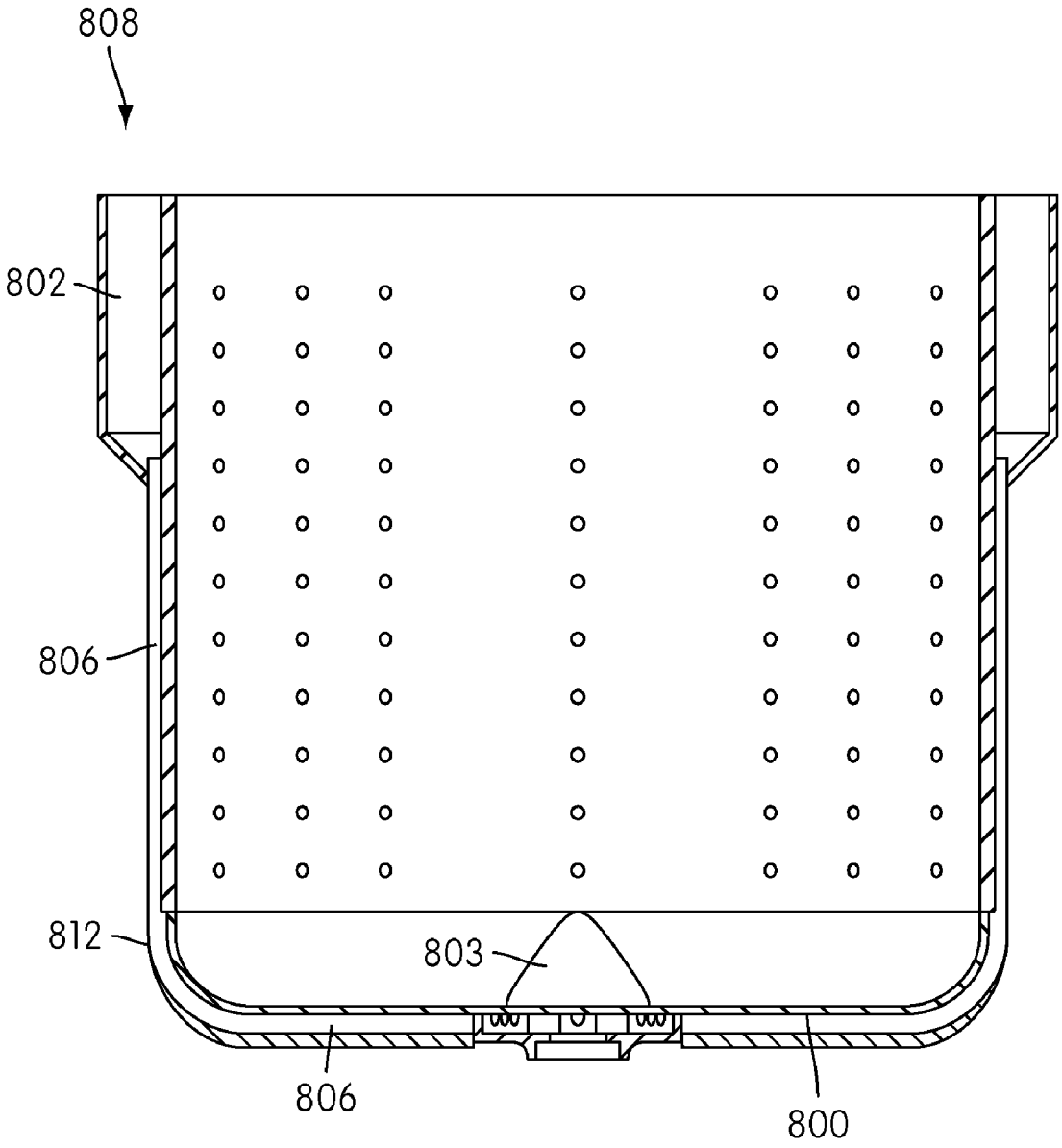
FIG. 10B is a cross-sectional view of the wash basin and internal plate of FIG. 10A, showing the plate in its nested position.

FIG. 10B is a cross-sectional view of the wash basin 808 of FIG. 10A and illustrates the manner in which plate 800 is nested within wash basin 808. The wash basin 808 includes an annular reservoir 802 and downward flow channels 806, as in the previous embodiment. For ease of manufacturing, the downward flow channels transition from the outer portion of the wash basin 808 to the inner portion of the wash basin 808 at bend 812. Once the transition is made, the downward flow channels 806 extend as open channels along the basin bottom. Plate 800 is positioned within the wash basin 808 to substantially cover the bottom surface of the wash basin and the lower open segments of the downward flow channels 806. In addition, plate 800 may cover a sediment trap, central drain area, or other mechanical features that may be visible without the plate. The plate may be provided with perforations 807 aligned with underlying channels, serving as a sediment trap provided in fluid communication with the central drain.

Plate 800 of FIGS. 10A and 10B may be formed of any material suitable for mating with the wash basin. For instance, the plate may be injection molded plastic piece, similar to the wash basin, or it may be constructed of stamped stainless steel. In one arrangement, bottom wash ramps 803 may be formed in plate 800 during manufacture. The structure and function of such ramps will be discussed further below. In addition, the position of the plate within the wash basin may be maintained with a friction fit. In other arrangements, the plate may be held in place with a snap fit, or it may be welded or bolted to the wash basin. In an alternate arrangement, the plate may be connected to the wash basin such that it moves relative to the wash basin. Such movement could be used, e.g., for contributing to a wash action within the wash basin.

Figure 9:
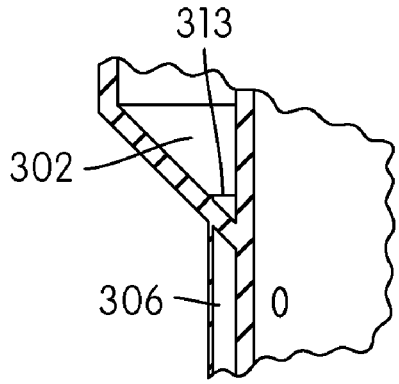
FIG. 9 is a close-up partial cross-sectional view of the upper portion of one of the downward flow channels of the wash basin in FIG. 7, extending into the stabilizing reservoir of the wash basin.

FIG. 9 shows more clearly the upper end 311 of a downward flow channel 306 where wash liquid enters downward flow channel 306 from the lower portion of stabilizing reservoir 302, once the liquid in the reservoir is permitted to settle following the spin cycle. During the spin cycle, the liquid is forced upwardly and outwardly within reservoir 302 such that no drainage occurs. Advantageously, this arrangement provides selective drainage of reservoir 302 without the need for a flow controlling valve/actuator.

The downward flow channels 306 wrap around the curved bottom surface of wash basin 108 and radially converge at a manifold 315 arranged about, and provided in fluid communication with, a central drain 310, as shown in FIGS. 10A and 11, 12 and 14. Once wash basin 108 completes its spin cycle, the wash liquid in stabilizing reservoir 302 drains from the reservoir 302, through the downward flow channels 306, to the central drain hole 310 (which accommodates drive shaft/drain pipe 114, as seen in FIG. 2).

Figure 13:
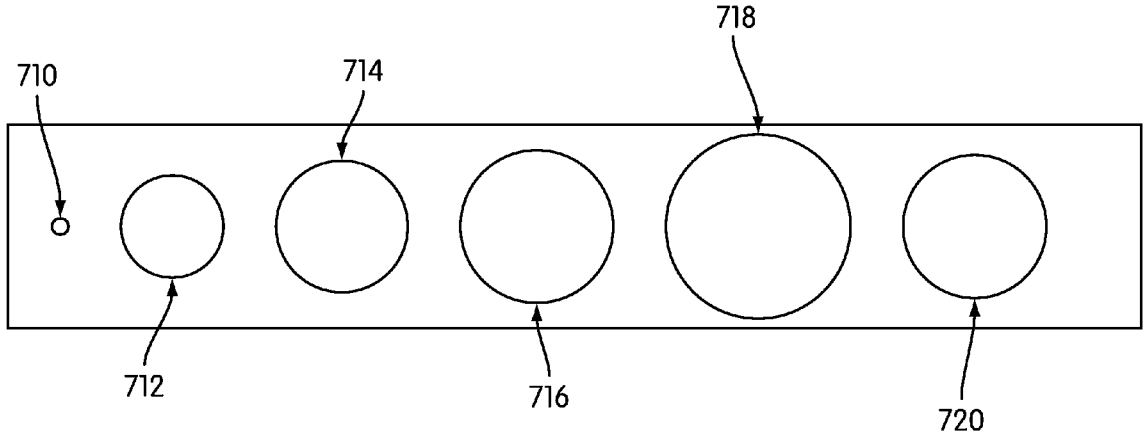
FIG. 13 is a diagram illustrating relative diameters of flow channels and orifices thereof in the paths taken by wash liquid removed from the wash basin in accordance with aspects of the invention.

The flow channels may advantageously be configured such that the size of the flow channels, and/or orifices thereof, increases from upstream to down (from wash basin to sewer), to prevent debris from entering into the flow channels and associated drain paths and subsequently blocking the same. FIG. 13 is a diagrammatic representation of relative flow orifice sizes in one possible embodiment. While being shown as circular, the shapes of the orifices may, and typically would, be other than circular (having, e.g., a semi-circular cross-section, as shown for channels 305 and 308 in FIG. 14). As shown in FIG. 13, the size of the aperture 710 in the wash basin through which the wash liquid exits is significantly smaller than the diameter of the upward flow channels 712. Upward flow channel 712 is smaller in diameter than downward flow channel 714. In addition, the size of the downward flow channels 714 is smaller than the diameter of the orifice 716 through which the wash liquid exits the downward flow channel and enters the central drain. Also, the center axis drain orifice 716 is smaller than the diameter of the drain hose 718 leading to the sewer. Static drain port 720 illustrates one example of the relative size of the static drain port. The exact size of the port 720 may be determined by the type and capacity of the drain pump used, taking into account its capacity to pass debris. By incrementally increasing the size of the drainage pathways, the possibility of debris becoming stuck and blocking the flow pathways from upstream to downstream can be significantly reduced, if not eliminated.

Figure 11:
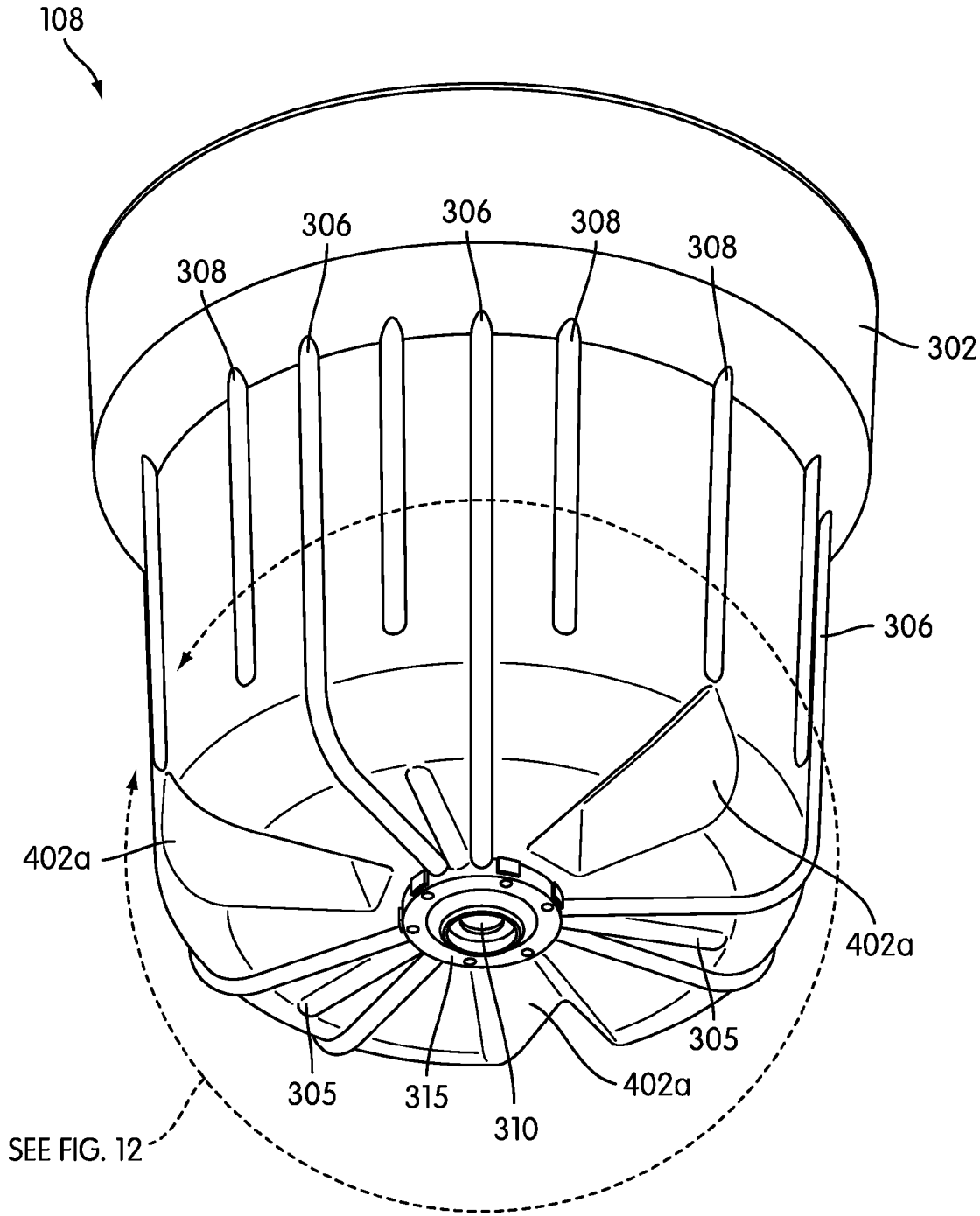
FIG. 11 is a perspective view of the bottom of the wash basin of FIG. 4 showing both the upward and downward flow channels, as well as a central drain.
Figure 12:
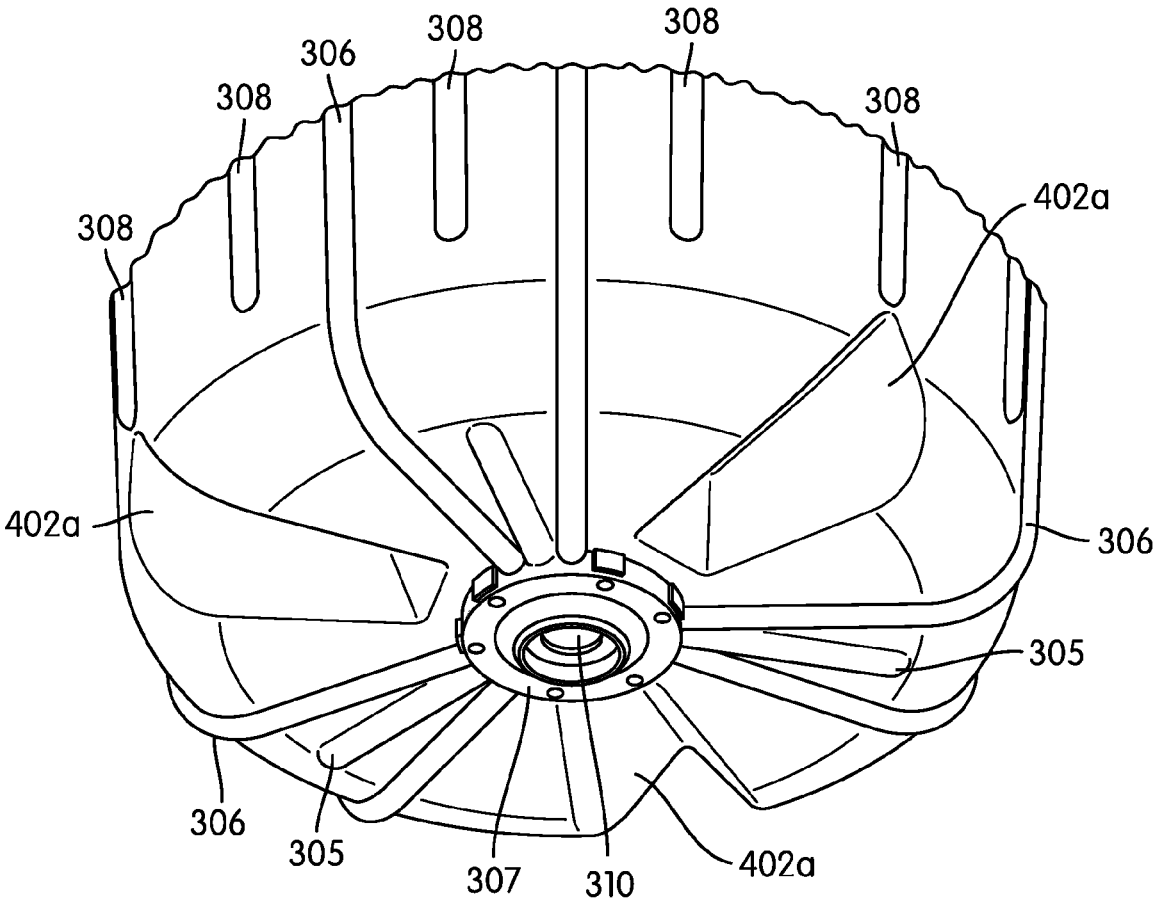
FIG. 12 is a close up partial perspective view of the exterior bottom portion of the wash basin of FIG. 4.
Figure 14:
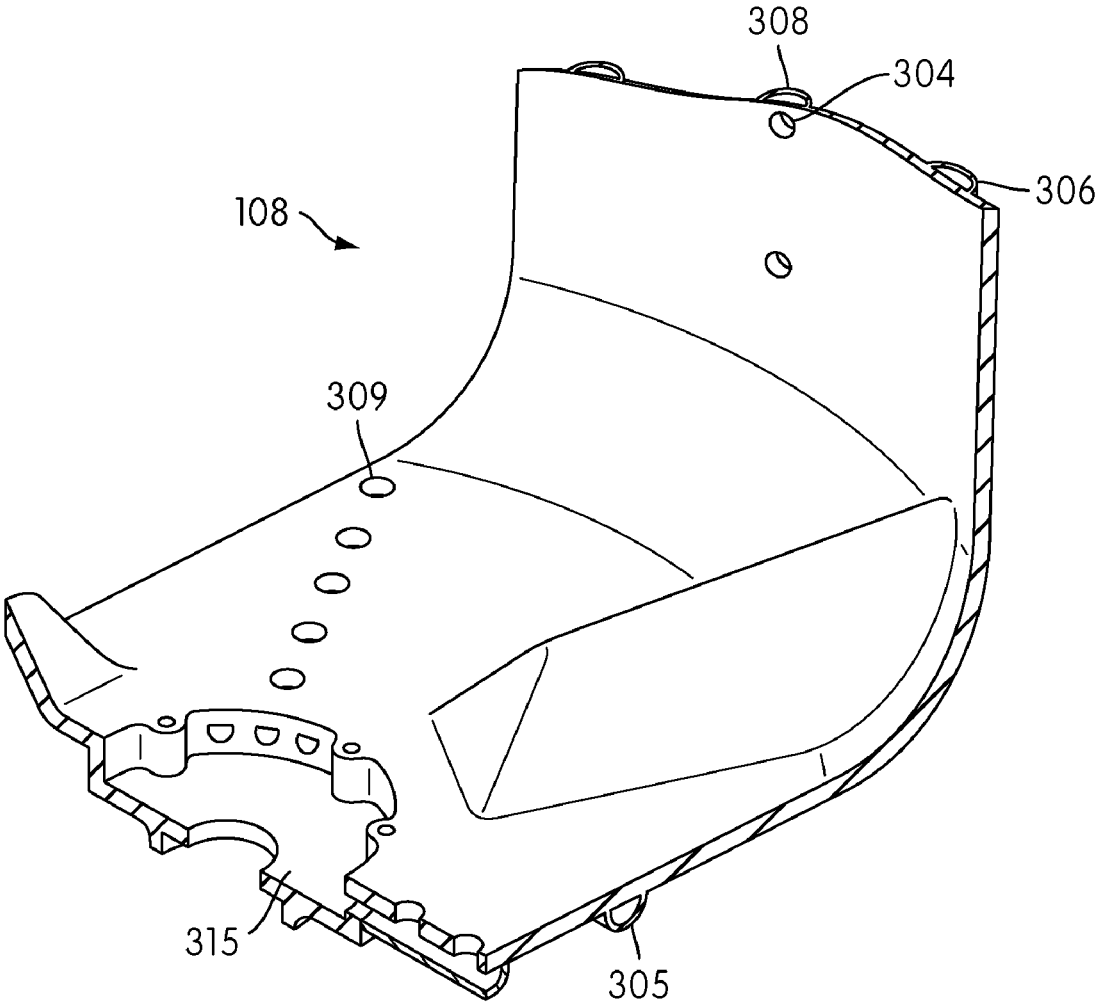
FIG. 14 is a close up partial perspective view of the interior bottom portion of the wash basin of FIG. 4.

FIG. 14 illustrates the interior portion of one arrangement of the bottom of wash basin 108. The upward and downward flow channels 308, 306 are visible on the outer portion of wash basin 108. In addition, apertures 304 for draining extracted wash liquid are shown in alignment with the upward flow channels 308. Holes 309 are provided in the bottom surface of the wash basin 108. Holes 309 serve to remove any sediment that may settle to the bottom portion of wash basin 108. The sediment is removed from the system via the central drain (hole 310 shown in FIGS. 11 and 12; drain pipe/drive-shaft 114 shown in FIG. 2). As shown in FIGS. 11, 12 and 14, the sand holes 309 align with channels 305 formed in the bottom of wash basin 108. These channels 305 feed into the center manifold 307, that then feeds into central drain 310/114. The central drain allows sediment, as well as wash liquid drained from the wash load, to exit the system. The sediment and wash liquid is channeled to pump 190 (FIG. 2) that pumps the wash liquid out of the system and into a sewer or other home drainage system. In arrangements in which a central column is used, the central column may include perforations to allow wash liquid to exit the wash basin and enter the central drain therethrough.

The flow channel and reservoir arrangement described above advantageously eliminates the need for an outer, stationary splash tub, as used in conventional systems. In the conventional arrangement, the stationary splash tub acts as a reservoir for collecting the wash liquid spun from the wash basin. On the other hand, in accordance with the invention, upward flow channels 308 direct the wash liquid to reservoir 302 as it is spun from the wash basin, thus eliminating the need for an outer, stationary tub. By removing the outer tub from the washing machine, a larger wash basin may be used within a standard sized washing machine cabinet. Further, a single tub arrangement decreases the weight and manufacturing costs associated with providing an outer stationary tub.

Additionally, the single tub arrangement allows for conservation of water by maximizing the amount of water in the wash basin, unlike a conventional arrangement wherein water between the tubs does not aid in wash performance. Also, the single tub arrangement eliminates the need for a clutch and gearbox arrangement as used in conventional systems. The clutch and gearbox not only add to the weight and cost of the washer, but also add mechanical complexity which can lead to the need for additional servicing of the washer throughout its lifespan. Quieter operation is also possible through elimination of the gearbox. Still further, a single tub arrangement as described may also eliminate the need for a mechanical brake, since the start and stop of the spin of the tub can be precisely controlled by the motor (including very high accelerations and decelerations). The ability to rapidly decelerate the tub upon opening the washer lid may also eliminate the need for a lid lock to conform with generally accepted safety practices and governmental or industry regulations.

In conventional washing machines, the central column may rotate or oscillate to act as a wash load agitator for inducing a wash action during the wash cycle, independently of the wash basin rotation. As mentioned, illustrated column 112 does not serve as an agitator for inducing a wash action. Rather, in accordance with another aspect of the invention, a unique wash action and circulation of the laundry load is achieved with an arrangement of wash action ramps and a sequence of tub rotation starts and stops, as will now be described.

FIGS. 11, 12, 15 and 16 depict additional inventive wash cycle aspects of an automatic washing machine, which may be used with or independent of the above-described spin-drain aspects. Wash basin 400 of FIGS. 15 and 16 includes upward flow channels 306 for directing wash liquid to reservoir 404 and downward flow channels (not visible) for directing the wash liquid from the reservoir 404 to the central drain, as previously described. In addition, it can be seen that wash basin 400 of FIGS. 15 and 16 includes wash action ramps 402*a*, 402*b* mounted on the circular bottom and cylindrical sides of the wash basin 400. Similar ramps 117, 117', 803 and 402*a* are depicted in e.g., FIGS. 3, 5B, 10A, 11 and 12. These ramps serve, in conjunction with a controlled sequence of tub accelerations and decelerations, to impart a wash action and circulation of the load within the wash basin, thus eliminating the need for a central agitator and an associated transmission for permitting the agitator and wash basin to rotate independently. This controlled sequence may be carried out using an electronic controller that may, e.g., be provided as an integral part of control panel 104 shown in FIG. 1. Such a controller may comprise a suitably programmed microprocessor or application specific integrated circuit (ASIC), operably connected to suitable circuitry for driving the wash basin drive motor in accordance with commands of the controller.

One or more wash action ramps 402*a* may be molded into the bottom of wash basin 400 and have a generally triangular transverse cross-section, as illustrated in FIGS. 11, 12, 15 and 16. Although excellent results have been obtained with a single wash action ramp 402*a* affixed to the bottom of the tub and offset from the axis of rotation, in the illustrated arrangement three wash action ramps are located on the bottom of the tub in equispaced relationship about the axis of rotation. Alternatively, a second wash action ramp 402*a* may be positioned on the bottom of the wash basin 400 at a position radially opposed to the first. Preferably, the ramp structures are positioned so as to provide a center of gravity coinciding with the axis of rotation. This advantageously provides balance during high speed tub spins without the need for any additionally counterbalancing structure.

As the wash basin 400 begins to accelerate at the outset of a wash action control sequence, the wash action ramps 402*a* sweep through the initially static pool of wash liquid to impart a wave wash action on the wash liquid. This action is, by virtue of water shear, generally confined to a lower portion of the wash basin 400. This is the first component of a mechanical wash action and contributes to good mixing of the wash load in the lower half of the wash basin 400. Additional wave wash action occurs when the wash basin 400 decelerates. While the water mass is rotating with the basin, a subsequent deceleration of the wash basin causes the rotating mass of water to sweep over the ramps as they slow down and stop. Overall, the movement of the ramp 402*a* relative to the water creates a wave turbulence that flexes the wash load to impart an excellent wash action.

Figure 15:
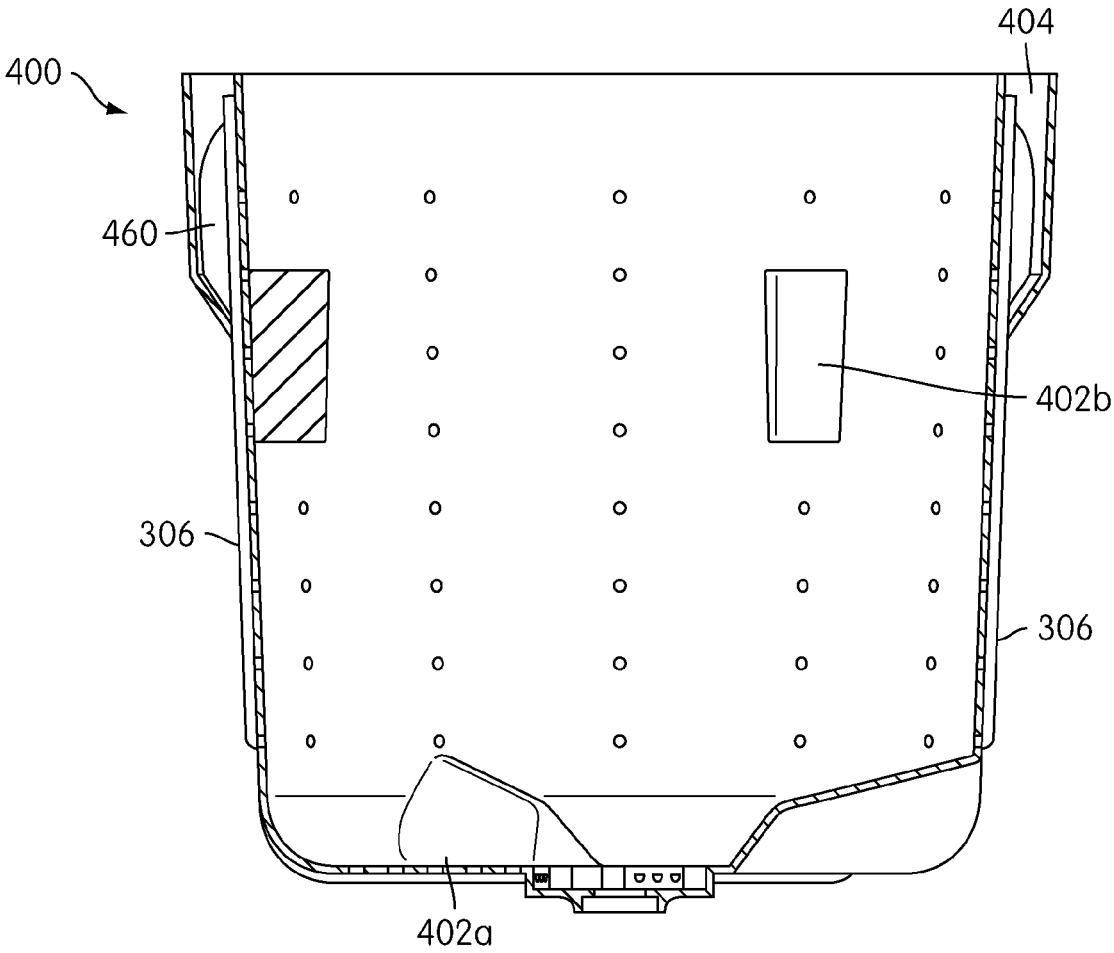
FIG. 15 is a radial cross-sectional view of another arrangement of the wash basin in accordance with an aspect of the invention, showing side and bottom mounted wash action ramps.
Figure 16:
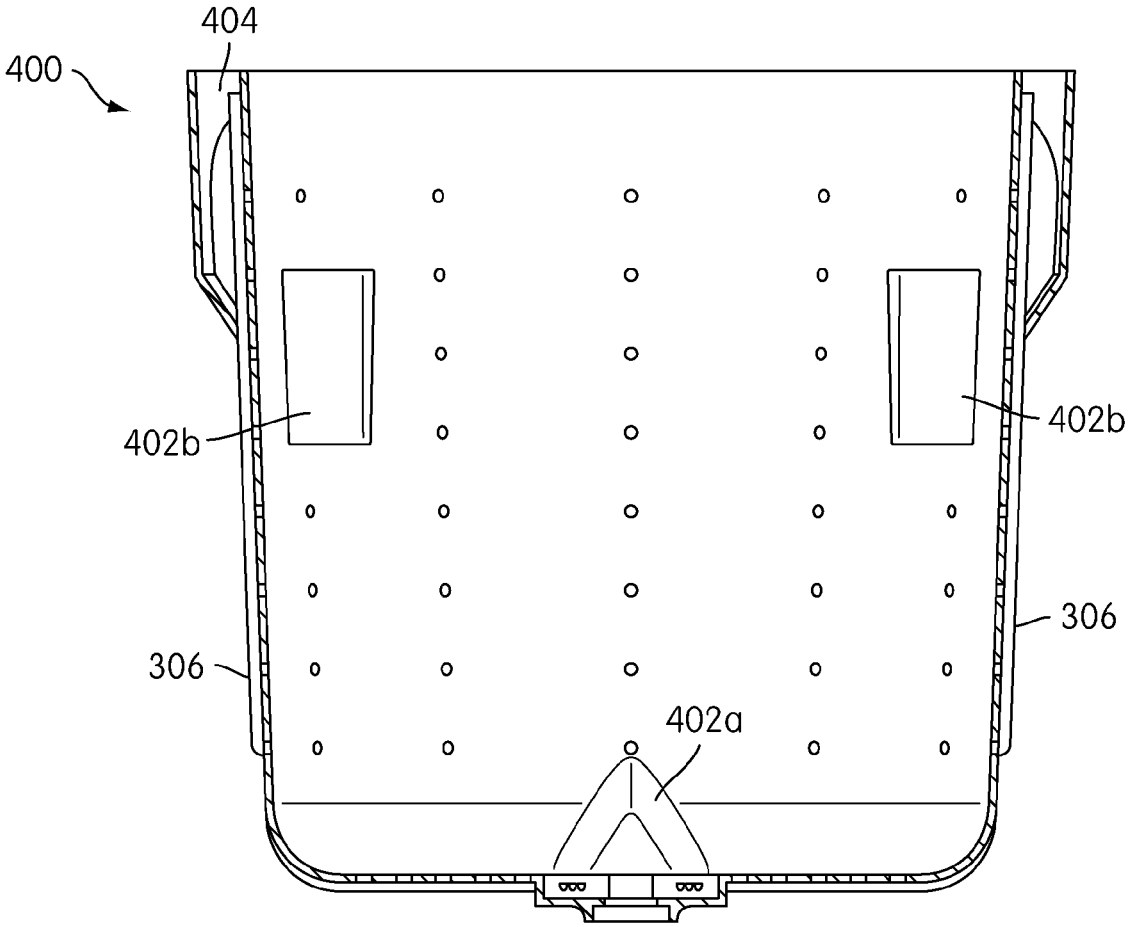
FIG. 16 is a radial cross-sectional view of the wash basin of FIG. 14, rotated 90 degrees.

As illustrated in FIGS. 15 and 16, at least one additional wash action ramp 402*b* may be affixed at an upper portion of the sidewall of the wash basin 400. These sidewall ramps are preferably positioned above what would be expected to be the standing water line for a typical load size. Positioning the sidewall ramps 402*b* above the standing water line reduces water-induced drag during spins of the wash basin, and increases load capacity in the lower part of the wash basin. However, the sidewall wash action ramp 402*b* may become partially submerged, especially in the case of an extremely large wash load. As the bottom ramps 402*a* aid in washing of the wash load, the upper wash action ramp will aid in mixing and circulating the wash load, and secondarily serve to impart some additional wash action as well. Generally, as the load size increases, the wash action and load circulation inducing function of the upper ramps increases in importance, for reasons to be explained.

Figure 19:
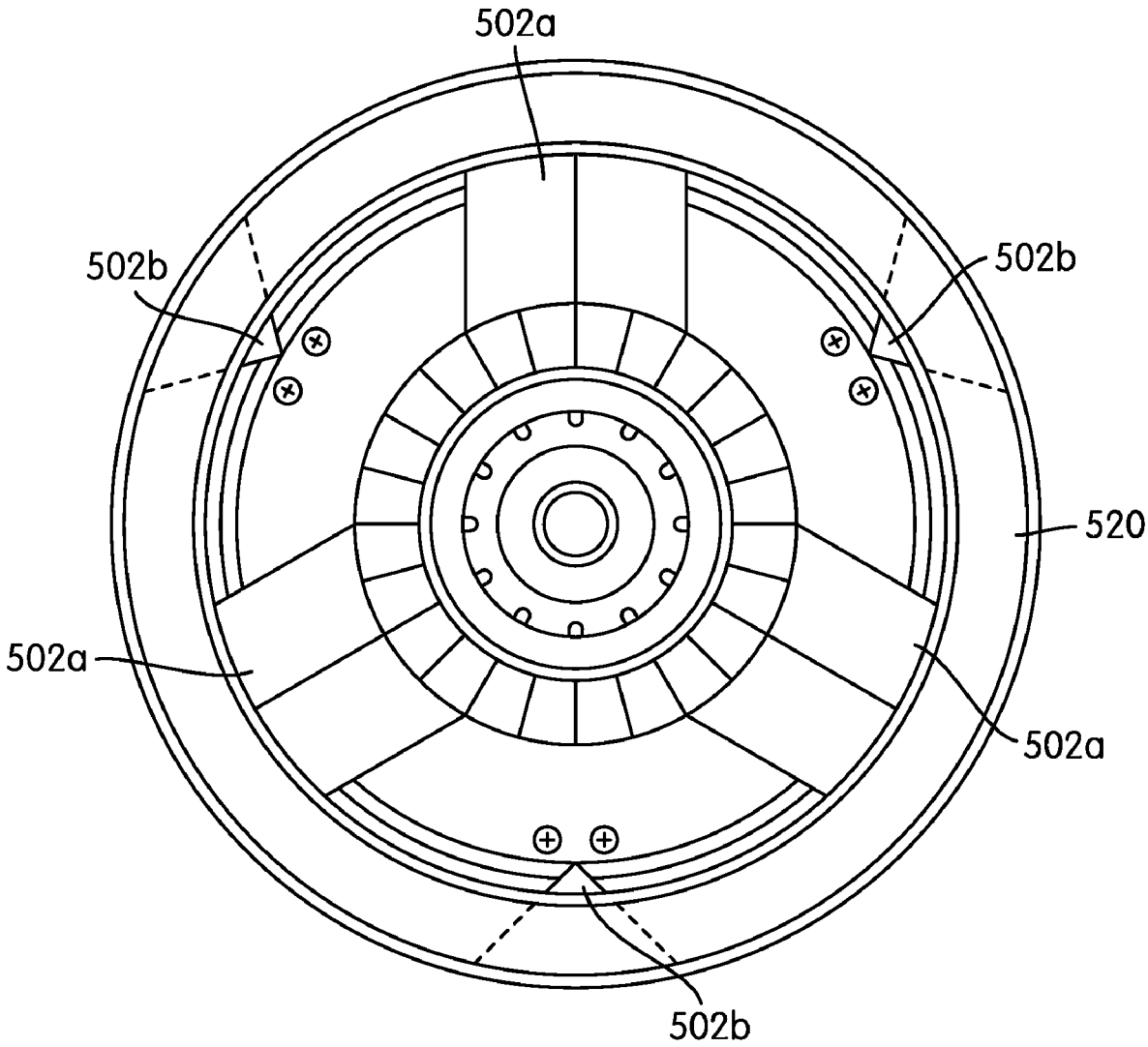
FIG. 19 is a top plan view of the wash basin of FIG. 16 showing yet another arrangement of the wash action ramps.
Figure 20:
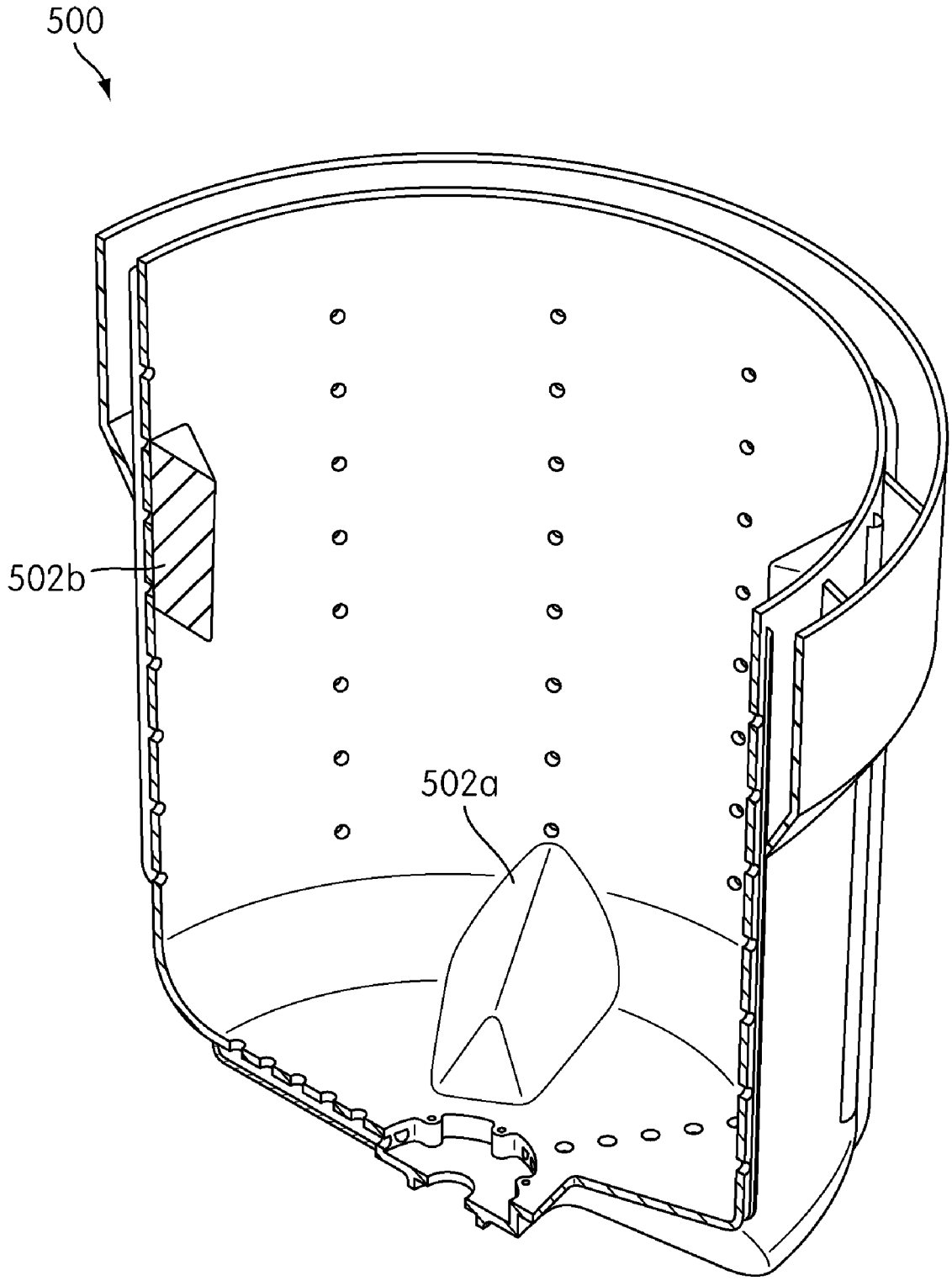
FIG. 20 is a cross-sectional perspective view of the wash basin of FIG. 16.

The cross-sectional views of FIGS. 15 and 16 illustrate a wash basin configuration having three lower wash ramps 402*a* working in conjunction with three upper wash ramps 402*b*. In this specific embodiment, an equal number of lower ramps 402*a* and upper wash ramps 402*b* are provided, and the lower wash ramps 402*a* are offset from the upper wash ramps 402*b*. As illustrated, each of the ramps has a symmetrical shape (e.g., of an equilateral triangle, as also shown in FIGS. 19 and 20) providing a pair of opposed ramp surfaces, each being operative to create a wave wash action for a given direction of basin rotation. In an alternate arrangement, the ramps may have an asymmetrical shape to aid in control of a cycle. For instance, a less substantial angle on one side of the ramp may be favored as the face primarily impacted against the water mass during wash basin accelerations and/or decelerations when used with a gentle cycle, while the other side may have a more severe angle which will be favored (in the same sense) when used with a normal cycle. More specifically, the wash basin accelerations and decelerations may be tailored to make the most advantageous use of differing shape profiles provided on opposite sides of the ramps, for providing cycle control.

FIGS. 19 and 20 further illustrate the shape and arrangement of the ramps within the wash basin. As shown in FIG. 19, the sidewall ramps 502*b* are shown as partially hidden by the conventional stabilizing ring 520. The equidistant spacing of the bottom ramps 502*a* and sidewall ramps 502*b* is also evident from the arrangement shown in FIG. 19. FIG. 20 provides a sectional view of one arrangement of a wash basin. One arrangement of the relative position of the bottom ramps 502*a* to the sidewall ramps 502*b* is shown. In the arrangement of FIG. 20, the bottom ramps 502*a* are offset from the sidewall ramps 502*b*, and. the bottom ramps slope or taper downward toward the center of the wash basin (are radially inclined). More mechanical wash action occurs on the radially outward perimeter, than it does adjacent the rotation axis. Thus, by tapering the ramps toward the rotation axis, torque and drag on the motor can be reduced with negligible or minimal impact on wash action.

Figure 17:
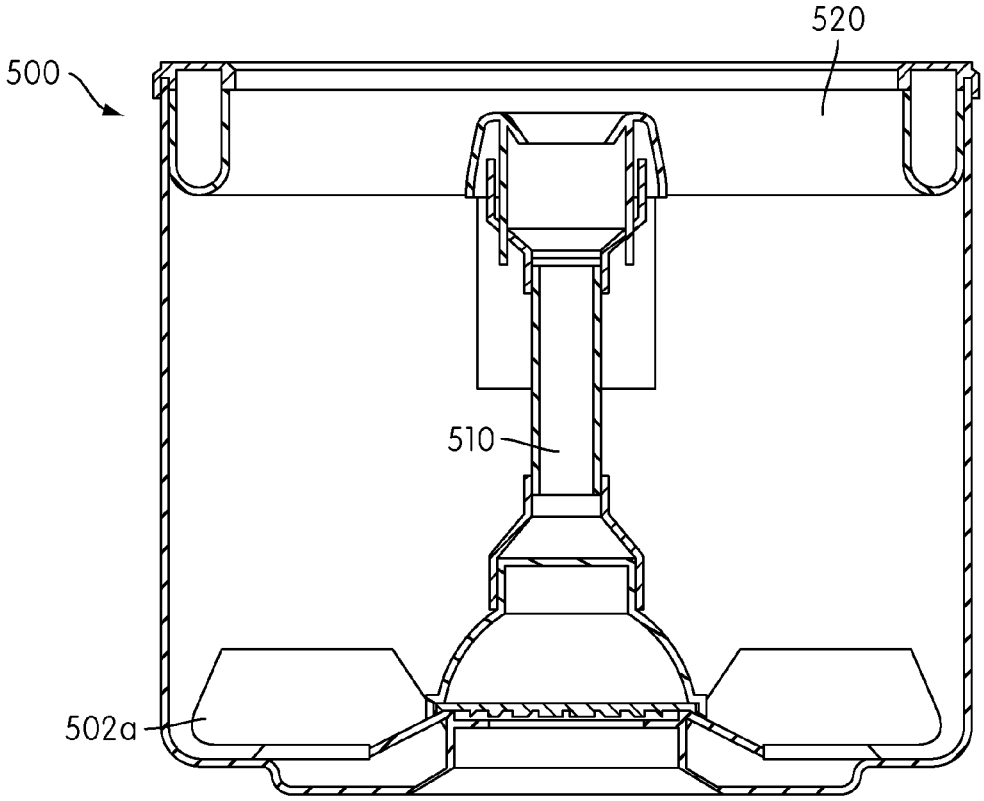
FIG. 17 is a radial cross sectional view of another arrangement of the wash basin, including a central column and wash action ramps.
Figure 18:
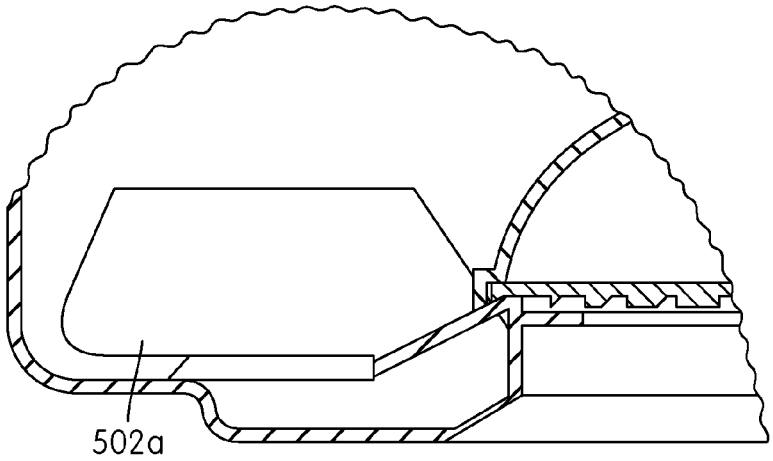
FIG. 18 is a close-up partial perspective view of the wash basin of FIG. 16, showing more clearly a wash action ramp thereof.

Although illustrated primarily in conjunction with a single wash basin (tub) embodiment, an arrangement of wash action ramps as described may also be implemented in a washing machine having a conventional dual tub arrangement. FIGS. 17-19 and 21A-21D illustrate the wash action ramps aspects of the invention as generally applied to a wash basin that includes a conventional sealed stabilizing ring 520 (FIG. 17). In FIG. 19, the side ramps 502*b* are shown partially hidden beneath this stabilizing ring 520. This wash basin could be a perforated wash basin intended to be nested within a stationary outer splash tub in a conventional manner. Alternatively, wash basin 500 may be equipped with the inventive flow channels and reservoir as previously described, in which case an outer tub could be omitted. In addition to the previously described advantages of a single tub embodiment, utilization of the wash action ramps aspects in a single tub embodiment has the advantage of avoiding water drag on the outside of the wash basin during the wash cycle spins. Such drag would be present in a nested (two) tub embodiment, due to the presence of the wash liquid on both sides of the nested wash basin.

Figure 21A:
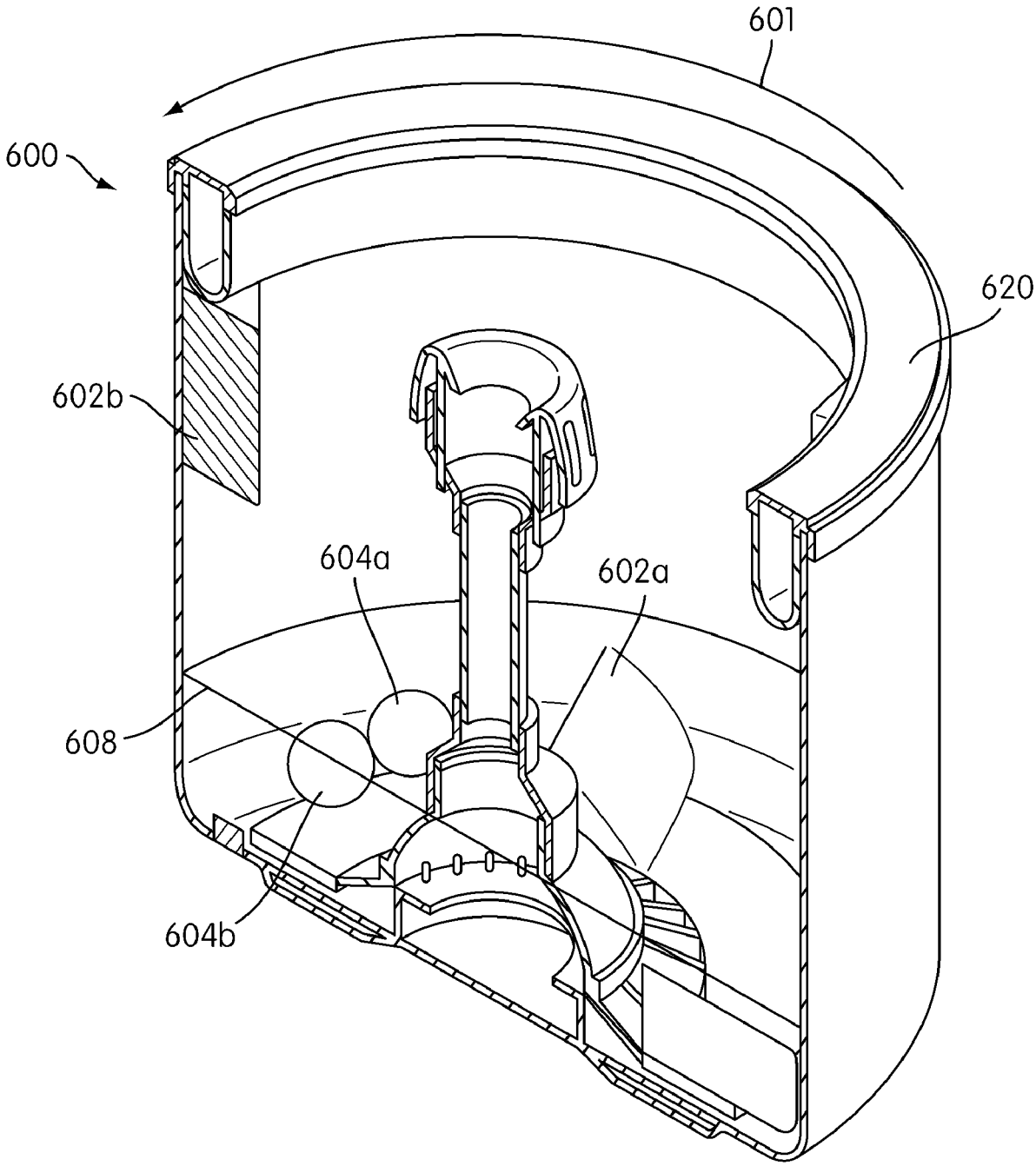
FIGS. 21A through 21D are sequential perspective views of the wash basin of FIG. 16, illustrating sequential wash actions imparted on a load by virtue of the wash action ramps, and a sequence of wash basin accelerations and decelerations, in accordance with aspects of the invention.

FIGS. 21A-21D sequentially illustrate the wash action imparted on a wash load using the wash action ramps 602*a*, 602*b* and a sequence of tub rotation acceleration and deceleration intervals. In FIG. 21A, the wash cycle begins by filling the bottom of the wash basin 600 with a wash liquid 608 to an appropriate level. In the arrangement of FIG. 20A, a low water level, corresponding to a small wash load, is shown to clearly depict the wave action imparted on the wash load. Of course, it is expected that higher water levels corresponding to larger wash loads would also be used. The balls 604*a*, 604*b* diagrammatically represent items of a wash load. Once the wash basin 600 is filled to a predetermined level with wash liquid 608, the wash basin 600 is accelerated to spin at a high rate. As illustrated in FIG. 21A, the wash basin 600 initially spins in a counter-clockwise direction.

Figure 21B:
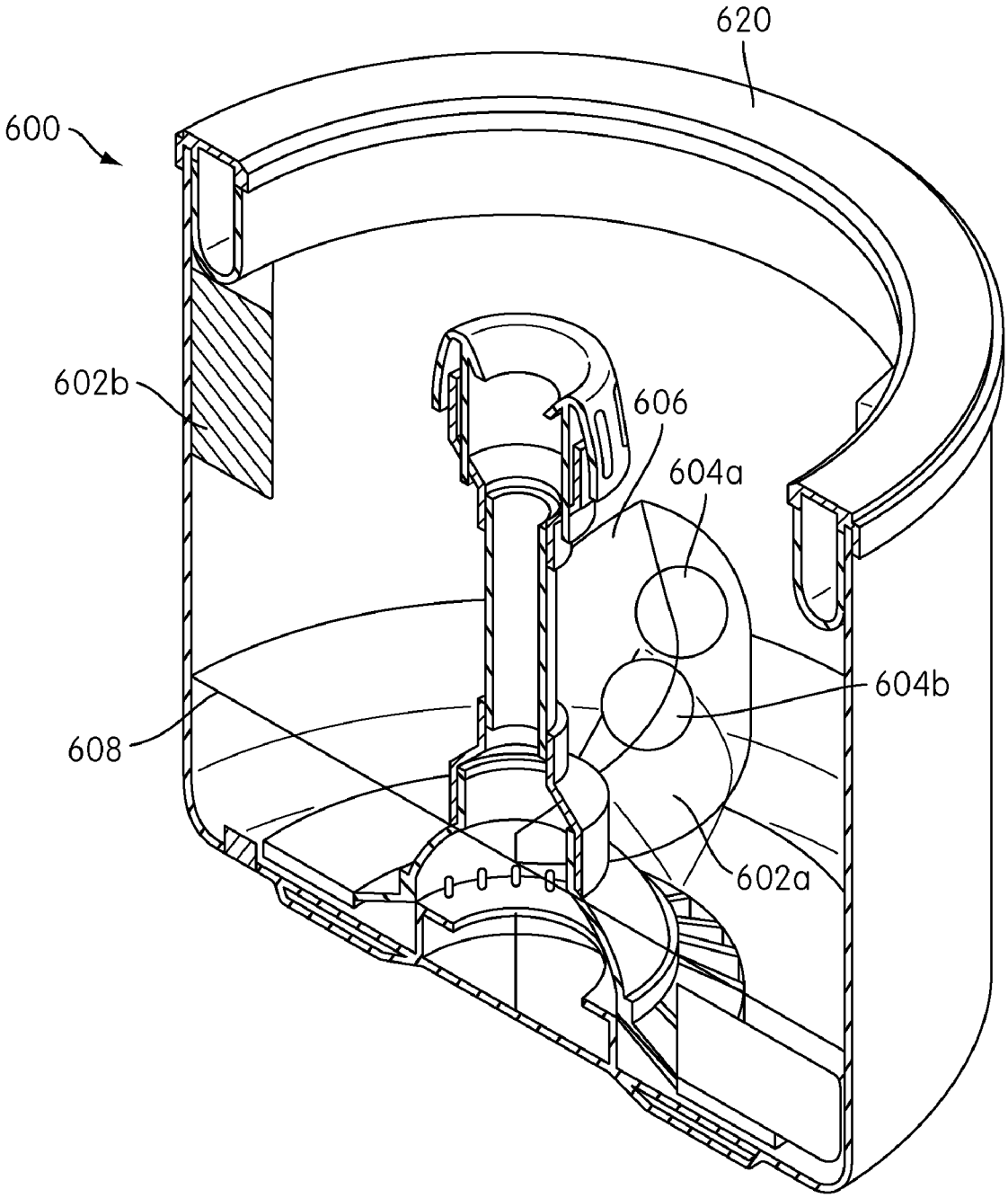

With reference to FIG. 21B, as the wash basin 600 accelerates, the inertia of the wash liquid 608 causes the wash liquid 608 to initially resist rotation with the basin 600. This causes the leading faces of the bottom wash action ramps to impart a large wave action on the wash liquid 608. A wave 606 is diagrammatically illustrated. The three bottom wash action ramps 602*a* are spaced equidistant around the bottom surface of the wash basin 600 to induce a multi-peaked wave action throughout the entire lower portion of the wash basin 600. This wave action provides a first component of an induced mechanical wash action, and causes the wash load 604*a*, 604*b* to flex around and over the ramps 602*a* to provide excellent washing action as the ramps sweep through the water mass. An additional component of the wash action occurs because the moment of inertia of the wash load 604*a*, 604*b* is different from that of the wash liquid 608. As a result of this difference, additional wash action occurs in the form of relative fluid flow over and through the wash load 604*a*, 604*b* as the water mass begins to rotate relative the wash load.

Figure 21C:
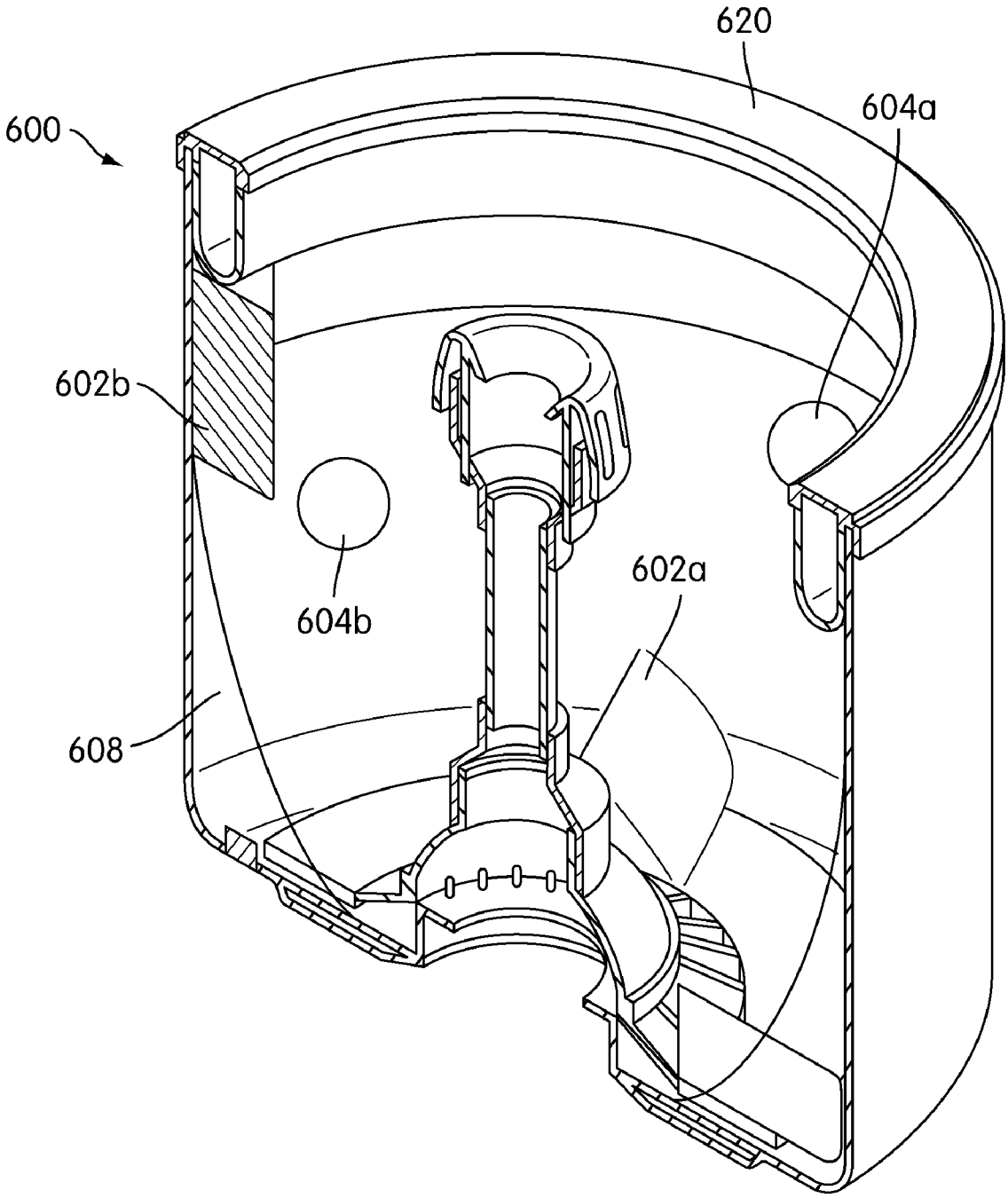

With reference to FIG. 21C, as the speed of the rotation of the wash basin 600 increases, and friction causes the water mass to rotate with the wash basin, centrifugal force causes the wash liquid 608 to flow outward toward the wall of the wash basin 600. As the speed accelerates above 1 G, the wash liquid 608 climbs the sidewall proportionately to $r\omega^2$, where r is the radius of the wash basin 600 and $\omega$ is the angular velocity of the wash basin 600. As the wash liquid 608 approaches the same speed of rotation as the wash basin 600, the wash liquid 608 will take on a parabolic profile. At this speed, the wash liquid 608 height may reach the upper wash action ramps 602*b* which, as previously mentioned, are preferably positioned above the standing water line. The distribution caused by the parabolic shape encourages a mixing and circulation of the wash load 604*a*, 604*b*. In particular, as the water takes on a parabolic shape, the water level rises along the sidewall and carries with it a portion of the wash load 604*a*, 604*b*.

Figure 21D:
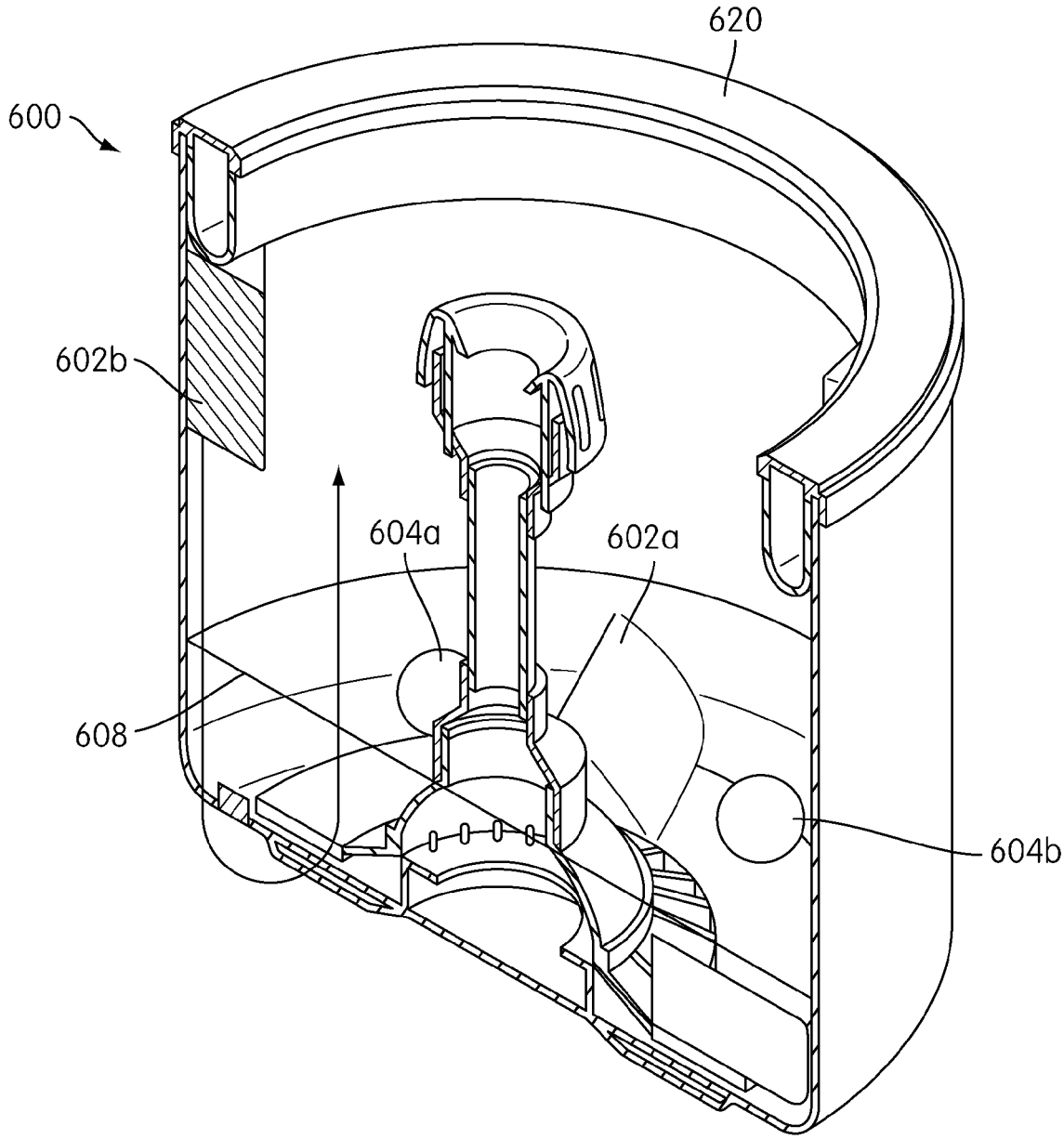

With reference to FIG. 21D, rotation of the wash basin 600 is abruptly decelerated to a stop, causing additional components of a mechanical wash action to occur. First, at the moment of braking, the sidewall mounted ramps 602*b* present guide surfaces that encourage an upper portion of the wash load 604*a*, 604*b* to move inwardly, toward the wash basin's 600 center of rotation, where it will tend to drop (circulate) toward the bottom.

In addition to the sidewall ramp induced circulation and wash action generated upon the wash basin spin deceleration, the parabolic shape of the wash liquid 608 will dramatically collapse, causing mixing of the load. In particular, the collapse of the parabola causes the wash liquid 608 to rush down the sidewall of the wash basin 600 and up, into the center of the wash basin 600, where momentum carries the liquid (and the load) upwardly along the central column. In addition to circulating the load, the collapsing wash liquid 608 causes the wash load 604*a*, 604*b* to continue to mix and circulate as the wash liquid 608 rushes down the sidewall and up, into the center of the wash basin 600. In one arrangement, excellent mixing occurs when the parabola is driven as high as possible up the sidewall using rapid acceleration, and a strong forceful collapse of the parabola is precipitated by rapid braking.

Also, at the point of deceleration, the inertia of the wash load 604*a*, 604*b* causes the wash liquid and wash load 604*a*, 604*b* to continue to rotate longer than the wash basin 600, thereby inducing a wave wash action similar to that induced with the acceleration of wash basin 600. The relative motion of the ramps, the wash liquid and the wash load causes the wash load 604*a*, 604*b* to flex and flow over and around the ramps, and wash liquid to flow through the wash load, thereby providing an excellent multi-component wash action. As the size of the load increases, the size of the parabola generally decreases. Thus, with a large load, the sidewall ramps assume a relatively greater role in mixing/circulating of the load.

The wash action illustrated in FIGS. 21A-21D may be repeated over and over a number of times for the duration of the wash cycle.

In a preferred arrangement, the wash basin 600 is caused to alternately, successively rotate in opposing directions. For instance, the wash basin may rotate counter-clockwise then come to an abrupt stop. The following wash action may begin with the wash basin rotating in a clockwise direction, then coming to an abrupt stop, and so on. The wash cycle may continue in this manner of rotation for the duration of the wash cycle, or a portion thereof. Such spin patterns may be used in conjunction with differing ramp surface profiles to achieve cycle control, as previously described.

Figure 22:
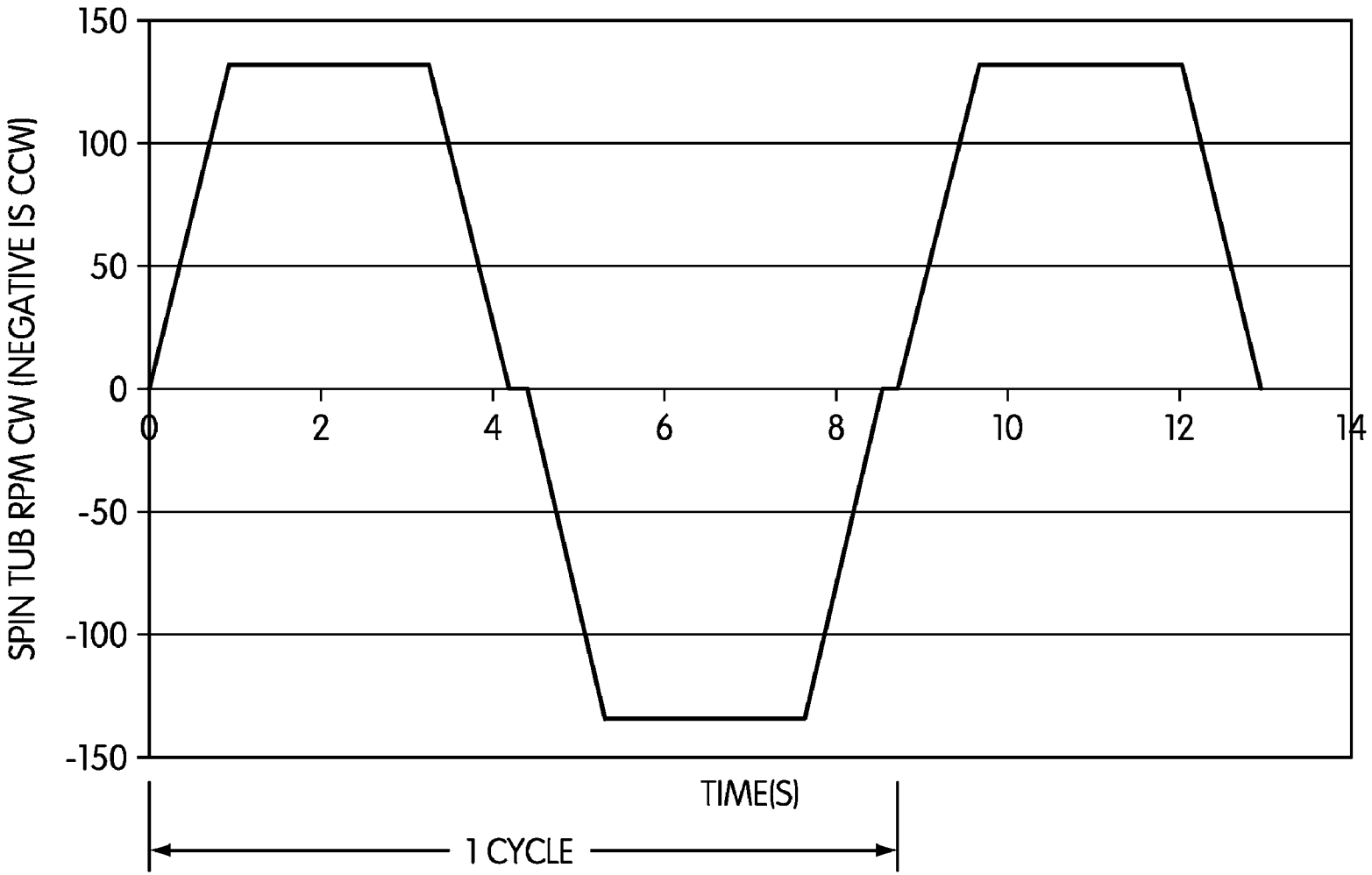
FIG. 22 is a graph illustrating an exemplary sequence of wash basin accelerations and decelerations, in accordance with an aspect of the invention.

The graph of FIG. 22 provides an example of successive spin tub (wash basin) acceleration and deceleration cycles as described. As is shown, a cycle begins with rapid rotational acceleration of the wash basin in the clock-wise (CW) direction. Once the desired speed of rotation is achieved, the rotation is briefly held at that speed before it is rapidly decelerated. Once the wash basin has stopped rotating, the rotation of the wash basin is again rapidly accelerated, however in an opposite direction, in this case counter-clockwise (CCW). The rotation speed is maintained for an interval and then is rapidly decelerated, as before. Once the rotation has stopped, the wash basin is again accelerated in the first direction (CW). The successive high speed tub rotations, in conjunction with the bottom and sidewall wash action ramps, can provide a highly effective method of washing a laundry load, in lieu of the conventional arrangement of a central, independently rotatable agitator.

In one arrangement, each complete cycle may last between 3 and 15 seconds. For example, one cycle may be approximately 9 seconds, allowing for approximately six cycles per minute. An extremely short cycle could comprise an acceleration phase of 1.5 seconds and a braking (deceleration) phase of 1.5 seconds, for a half-cycle time of three seconds (direction would then change and half cycle would repeat). A more typical half-cycle could comprise, sequentially, an acceleration phase of 5 seconds, a pause phase of 2.5 seconds, a braking (deceleration) phase of 5 seconds and another pause phase of 2.5 seconds, providing a half-cycle time of 15 seconds (direction would then change and half-cycle would repeat). For a single tub arrangement, such as the one described, a wash agitation cycle may last, in total, from 10 to 18 minutes. Additional cycles will occur during the rinse portion of the wash process. This rinse cycle time may vary depending on the cycle setting selected, e.g., 4 to 8 minutes. In one example, the rinse cycle is approximately 5 minutes.

Once the sequence of tub accelerations and decelerations comprising the wash cycle is complete, the wash liquid 608 (the "free" water pooled within the wash basin 600) may be drained through a central drain. The washing machine may then enter a spin cycle which dewaters the wash load further. In one example, the wash basin rotates at 700-800 rpm in order to optimize dewatering. In the case of an embodiment as shown in FIGS. 15 and 16, wash liquid may then exist via the apertures in the wash basin, pass through the upward flow channels, be collected in an annular stabilization reservoir, and ultimately flow downward through downward flow channels to a the central drain, as previously described. In an alternative arrangement, wherein the wash basin with wash action ramps is provided as a wash basket nested within an outer tub, the wash liquid may be static drained and spin-drained in a conventional fashion, through a drain outlet of the outer tub.

The invention has been described in terms of particular exemplary embodiments. Numerous other embodiments, modifications and variations within the scope and spirit of the appended claims will occur to persons of ordinary skill in the art from a review of this disclosure.

The invention claimed is:

1. A method of operating an automatic washing machine comprising a frame; and a wash basin assembly rotatably mounted within the frame, the wash basin assembly including a wash basin container having a bottom and sidewalls extending up from said bottom; and at least one bottom ramp connected to and extending upwardly from the wash basin container bottom and presenting an upwardly inclined ramp surface, said at least one bottom ramp being fixed to rotate with any rotation of said wash basin container, said method comprising the steps of:

filling said wash basin container with wash liquid to a designated level corresponding to a desired load size, said filling establishing a standing liquid level within said wash basin container below any sidewall ramp structure of said wash basin container sidewalls; and repeatedly intermittently rotatably driving and braking said wash basin container during a wash cycle of the washer, to thereby cause the wash basin container and said at least one bottom ramp connected thereto to alternatingly accelerate and decelerate, the rotation of said at least one ramp consisting of rotation with said wash basin container, said acceleration and deceleration causing said at least one bottom ramp to induce a wave wash action on wash liquid within a lower portion of the wash basin container, by liquid flowing over said at least one ramp as the liquid continues to rotate within the wash basin container following an acceleration/deceleration cycle of said wash basin container, and wherein said acceleration/deceleration cycle further induces in said wash liquid parabolic water profile formation and collapse actions serving to circulate the load so that a portion of the wash load in an upper portion of the wash basin container is circulated to a lower portion of the wash basin container, where it can be subjected to the wave wash action induced by the at least one bottom ramp.

2. An automatic washing machine, comprising:

a frame;

a wash basin assembly rotatably mounted within the frame, the wash basin assembly including:

a wash basin container having a bottom and sidewalls extending up from said bottom; and at least one bottom ramp connected to and extending upwardly from the wash basin container bottom and presenting an upwardly inclined ramp surface said at least one bottom ramp being fixed to rotate with any rotation of said wash basin container;

a wash liquid supply system for filling said wash basin container with wash liquid to a designated level corresponding to a desired load size, said filling establishing a standing liquid level within said wash basin container, said wash basin container sidewalls being free of any sidewall ramp structure extending below said standing liquid level;

a drive system for selectively rotatably driving said wash basin container and said at least one bottom ramp, which is not rotatable independent of said wash basin container; and a controller for controlling said drive system to repeatedly intermittently rotatably drive and brake said wash basin container during a wash cycle of the washer, to thereby cause the wash basin container and said at least one bottom ramp to alternatingly accelerate and decelerate, said acceleration and deceleration causing said at least one bottom ramp to induce a wave wash action on wash liquid within a lower portion of the wash basin container, by liquid flowing over said at least one ramp as the liquid continues to rotate within the wash basin container following an acceleration/deceleration cycle of said wash basin container, and wherein said acceleration/deceleration cycle further induces in said wash liquid parabolic water profile formation and collapse actions serving to circulate the load so that a portion of the wash load in an upper portion of the wash basin container is circulated to a lower portion of the wash basin container, where it can be subjected to the wave wash action induced by the at least one bottom ramp.

3. The automatic washing machine of claim 1, said wash basin assembly further comprising at least one sidewall ramp connected to the wash basin container sidewall and presenting an inwardly inclined ramp surface, said at least one sidewall ramp being spaced above the top of the at least one bottom ramp, being above said standing wash liquid level, and serving, in conjunction with said at least one bottom ramp, to circulate the load.

4. The automatic washing machine of claim 1, wherein said at least one bottom ramp is fixedly connected to the wash basin container bottom.

5. An automatic washing machine according to claim 3, wherein said at least one sidewall ramp urges an upper wash load portion inwardly toward the axis of rotation of the wash basin container where it tends to drop toward the bottom, and said parabola collapse action causes an upper wash load portion to circulate downwardly into the lower portion of the wash basin container along said sidewalls.

6. The automatic washing machine of claim 1, wherein said controller sequentially drives the wash basin container to rotate in one direction and then the other.

7. The automatic washing machine of claim 6, wherein said at least one bottom ramp is symmetrical in shape so as to present two equal but oppositely directed upwardly inclined ramp surfaces.

8. The automatic washing machine of claim 3, wherein said at least one sidewall ramp is symmetrical in shape so as to present two equal but oppositely directed inwardly inclined ramp surfaces, and said control sequentially drives the wash basin container to rotate in one direction and then the other.

9. The automatic washing machine of claim 6, wherein between each interval of forward and reverse rotation the wash basin container is maintained stationary for an interval of time.

10. The automatic washing machine of claim 1, wherein a total of three of said bottom ramps are provided.

11. The automatic washing machine of claim 3, wherein a total of three of said sidewall ramps are provided.

12. The automatic washing machine of claim 1, wherein the at least one bottom ramp has a generally triangular shape.

13. The washing machine of claim 1, wherein said wash basin container is mounted within said frame without any surrounding outer tub, such that static drainage of wash liquid from said wash basin container occurs through a drain provided in direct fluid communication with said wash basin container.

14. The washing machine of claim 13, wherein said wash basin assembly further comprises:

a reservoir arranged at least partially about the sidewalls of the wash basin container;

a first plurality of flow channels extending along said sidewalls and being provided in fluid communication with an interior of said wash basin container so as to receive a flow of wash liquid from within the wash basin container under centrifugal force generated upon rotation of said wash basin container, said flow channels being configured to direct the wash liquid along said sidewalls and into said reservoir; and a reservoir drain for draining wash liquid from said reservoir.

15. The washing machine of claim 13, wherein said wash basin assembly further comprises:

a reservoir arranged at least partially about the sidewalls of the wash basin container;

a liquid flow path being provided in fluid communication with an interior of said wash basin container so as to receive a flow of wash liquid therefrom, said flow path being configured to direct the wash liquid into said reservoir; and a reservoir drain for draining wash liquid from said reservoir.

16. The washing machine of claim 15, wherein said reservoir drain comprises a plurality of flow channels extending from said reservoir along said sidewalls.

17. The washing machine of claim 16, wherein said plurality of flow channels extend downwardly from said reservoir along said sidewalls to a central drain of said washing machine which also serves as a static drain for said wash basin container.

18. The automatic washing machine of claim 1, further including a central column extending upwardly from a central portion of said wash basin container bottom.

19. The automatic washing machine of claim 18, wherein the central column is affixed to said bottom so as not move relative to the wash basin.

20. The automatic washing machine of claim 18, wherein said central column tapered along its length to a narrowed generally central section.

* * * * *

UNITED STATES PATENT AND TRADEMARK OFFICE

CERTIFICATE OF CORRECTION

PATENT NO. : 7,757,324 B2
APPLICATION NO. : 11/610380
DATED : July 20, 2010
INVENTOR(S) : Steven Leidig et al.

It is certified that error appears in the above-identified patent and that said Letters Patent is hereby corrected as shown below:

Title Page item (75) INVENTORS, Page 1:

Please delete "Ellingson David Irwin" and insert --David Irwin Ellingson--

OTHER PUBLICATIONS, item (56) Page 2:

Please insert --Notification of Transmittal of the International Search Report and the Written Opinion of the International Searching Authority, or the Declaration mailed May 29, 2008 in corresponding International Application No. PCT/US2007/086010 filed November 30, 2007--

Please insert --Notification of Transmittal of the International Search Report and the Written Opinion of the International Searching Authority, or the Declaration mailed May 21, 2008 in International Application No. PCT/US2007/086082 filed November 30, 2007 corresponding to related U.S. application Serial No. 11/610,336--

Signed and Sealed this
Tenth Day of May, 2011

David J. Kappos

David J. Kappos
*Director of the United States Patent and Trademark Office*